US008910435B2

(12) United States Patent
Feldpausch et al.

(10) Patent No.: US 8,910,435 B2
(45) Date of Patent: Dec. 16, 2014

(54) PARTITION ASSEMBLY

(75) Inventors: Michael J. Feldpausch, Middleville, MI (US); Marvin C. Knauf, Conklin, MI (US); Bradley D. Youngs, Byron Center, MI (US); Mark T. Slager, Caledonia, MI (US); Kurt R. Heidmann, Grand Rapids, MI (US); John R. Hamilton, San Rafael, CA (US); Ryan Geister, Alto, MI (US)

(73) Assignee: Steelcase Inc., Grand Rapids, MI (US)

( * ) Notice: Subject to any disclaimer, the term of this patent is extended or adjusted under 35 U.S.C. 154(b) by 476 days.

(21) Appl. No.: 12/472,859

(22) Filed: May 27, 2009

(65) Prior Publication Data

US 2009/0293388 A1 Dec. 3, 2009

Related U.S. Application Data

(60) Provisional application No. 61/056,323, filed on May 27, 2008.

(51) Int. Cl.
*E04C 2/52* (2006.01)
*E04B 2/74* (2006.01)

(52) U.S. Cl.
CPC ..... *E04B 2/7422* (2013.01); *E04B 2002/7466* (2013.01); *E04B 2002/749* (2013.01); *E04B 2002/7483* (2013.01); *E04B 2002/7462* (2013.01)
USPC ..... 52/220.7

(58) Field of Classification Search
CPC ..... E04B 2/72; E04B 2/74; E04B 2/7405; E04B 2/7416; E04B 2/7425; E04B 2/7433; E04B 2/7437; E04B 2/7407; E04B 2/7429; E04B 2/7438; E04B 2/7444; E04B 2/76; E04B 2/7809; E04B 2/7818; E04B 2/82; E04B 2202/7418; E04B 2202/742; E04B 2202/7488; E04B 2202/749; E04H 1/00; E04H 1/005; E04H 1/12; E04H 1/1261; E04H 1/1266; H02G 3/288
USPC ..... 52/238.1, 239, 481.2, 241, 242, 243, 52/220.7, 463, 465, 466
See application file for complete search history.

(56) References Cited

U.S. PATENT DOCUMENTS

| | | | | |
|---|---|---|---|---|
| 3,749,432 | A | 7/1973 | Janssen | |
| 4,133,153 | A * | 1/1979 | Hage | 52/220.7 |
| 4,203,639 | A | 5/1980 | Vanden Hoek et al. | |
| 4,224,769 | A * | 9/1980 | Ball et al. | 52/36.1 |
| 4,270,020 | A | 5/1981 | Kenworthy et al. | |
| 4,277,123 | A | 7/1981 | Haworth et al. | |
| 4,278,834 | A | 7/1981 | Boundy | |
| 4,308,418 | A | 12/1981 | Van Kuik et al. | |
| 4,367,370 | A | 1/1983 | Wilson et al. | |
| 4,382,642 | A | 5/1983 | Burdick | |
| 4,593,505 | A * | 6/1986 | Russell | 52/220.7 |

(Continued)

*Primary Examiner* — Jessica Laux
(74) *Attorney, Agent, or Firm* — Price Heneveld LLP

(57) ABSTRACT

A beam assembly for subdividing a floor plan area comprises a horizontally-extending beam member including an interiorly-facing surface, a bottom wall having at least one aperture extending therethrough, and at least one horizontally-extending lower frame member located below the beam member. The beam assembly further comprises at least one vertical frame member extending between and coupled with the beam member and the at least one lower frame member, wherein the at least one vertical frame member extends through the at least one aperture and the bottom wall of the beam member and interferingly engages the interior-facing surface of the beam member.

16 Claims, 20 Drawing Sheets

(56) References Cited

U.S. PATENT DOCUMENTS

| | | | | |
|---|---|---|---|---|
| 4,596,098 | A | 6/1986 | Finkbeiner et al. | |
| 4,619,486 | A | 10/1986 | Hannah et al. | |
| 4,634,212 | A * | 1/1987 | Boundy et al. | 439/535 |
| 4,713,918 | A | 12/1987 | Cioffi | |
| 4,720,953 | A | 1/1988 | Onishi et al. | |
| 4,800,695 | A | 1/1989 | Menchetti | |
| 4,845,904 | A | 7/1989 | Menchetti | |
| 4,914,873 | A | 4/1990 | Newhouse | |
| 4,918,886 | A | 4/1990 | Benoit et al. | |
| 4,974,913 | A | 12/1990 | Vogt et al. | |
| 5,062,246 | A | 11/1991 | Sykes | |
| 5,081,809 | A | 1/1992 | Thompson | |
| 5,092,787 | A | 3/1992 | Wise et al. | |
| 5,155,955 | A | 10/1992 | Ball et al. | |
| 5,186,425 | A | 2/1993 | Keusch et al. | |
| 5,203,713 | A | 4/1993 | French et al. | |
| 5,207,037 | A * | 5/1993 | Giles et al. | 52/126.6 |
| 5,244,401 | A | 9/1993 | Russell et al. | |
| 5,274,970 | A | 1/1994 | Roberts | |
| 5,277,609 | A | 1/1994 | Ondrejka | |
| 5,318,454 | A | 6/1994 | Deer et al. | |
| 5,349,135 | A | 9/1994 | Mollenkopf et al. | |
| 5,362,923 | A | 11/1994 | Newhouse et al. | |
| 5,381,994 | A | 1/1995 | Welch | |
| 5,394,658 | A | 3/1995 | Schreiner et al. | |
| 5,428,928 | A | 7/1995 | Hellwig et al. | |
| 5,606,919 | A | 3/1997 | Fox et al. | |
| 5,607,317 | A | 3/1997 | King et al. | |
| 5,806,258 | A | 9/1998 | Miedema et al. | |
| 5,852,904 | A | 12/1998 | Yu et al. | |
| 5,901,512 | A * | 5/1999 | Bullwinkle | 52/220.7 |
| 6,009,675 | A | 1/2000 | Waalkes et al. | |
| 6,098,358 | A | 8/2000 | Waalkes et al. | |
| 6,152,048 | A | 11/2000 | Vander Park | |
| 6,161,347 | A | 12/2000 | Yu et al. | |
| 6,176,561 | B1 | 1/2001 | Roels et al. | |
| 6,202,381 | B1 | 3/2001 | Dame et al. | |
| 6,218,612 | B1 * | 4/2001 | McKitrick et al. | 174/495 |
| 6,253,509 | B1 | 7/2001 | Hellwig et al. | |
| 6,295,775 | B2 | 10/2001 | Osterman et al. | |
| 6,301,846 | B1 * | 10/2001 | Waalkes et al. | 52/239 |
| 6,311,441 | B1 | 11/2001 | Beavers et al. | |
| 6,330,773 | B1 | 12/2001 | MacDonald et al. | |
| 6,349,516 | B1 | 2/2002 | Powell et al. | |
| 6,351,917 | B1 | 3/2002 | MacDonald et al. | |
| 6,357,199 | B2 | 3/2002 | Laukhuf et al. | |
| 6,367,213 | B1 | 4/2002 | Reuter et al. | |
| 6,408,579 | B1 | 6/2002 | Anderson et al. | |
| 6,420,727 | B1 | 7/2002 | Kano | |
| 6,481,168 | B1 | 11/2002 | Hodges et al. | |
| 6,490,829 | B1 | 12/2002 | Schreiner et al. | |
| 6,575,777 | B2 | 6/2003 | Henriott et al. | |
| D477,153 | S | 7/2003 | Thorp et al. | |
| 6,651,396 | B2 | 11/2003 | DeRuiter et al. | |
| 6,658,805 | B1 | 12/2003 | Yu et al. | |
| 6,725,784 | B2 | 4/2004 | Crinion | |
| 6,754,998 | B2 | 6/2004 | Diffrient et al. | |
| 6,761,004 | B2 | 7/2004 | Anglin et al. | |
| 6,807,776 | B2 | 10/2004 | Girdwood et al. | |
| 6,851,226 | B2 | 2/2005 | MacGregor et al. | |
| 6,865,853 | B2 | 3/2005 | Burken et al. | |
| 6,910,306 | B2 | 6/2005 | Waalkes et al. | |
| 6,910,903 | B2 | 6/2005 | Kondas | |
| 6,920,727 | B2 | 7/2005 | Yu et al. | |
| 6,951,085 | B2 | 10/2005 | Hodges et al. | |
| 7,055,287 | B2 | 6/2006 | Yu et al. | |
| 7,193,159 | B2 | 3/2007 | Makwinski et al. | |
| 7,249,624 | B2 | 7/2007 | Zeh et al. | |
| 2002/0088188 | A1 * | 7/2002 | Chang | 52/238.1 |

* cited by examiner

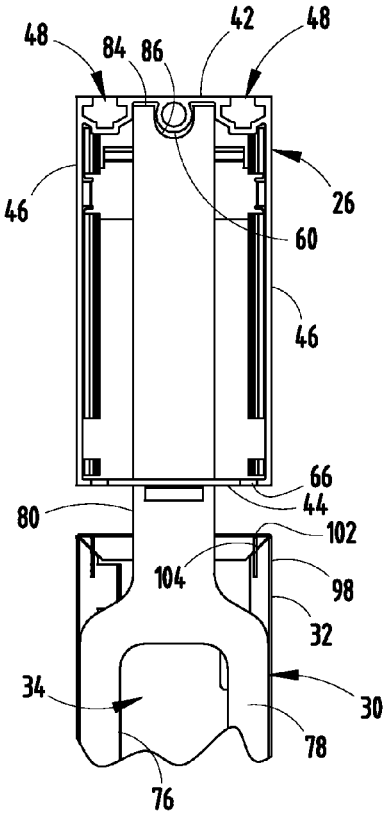
FIG. 10
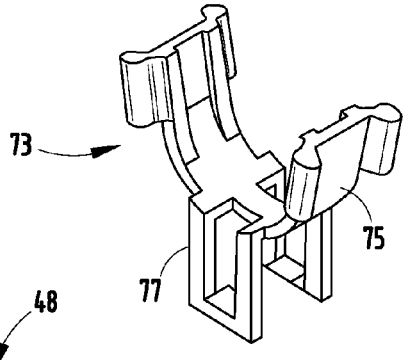
FIG. 10A
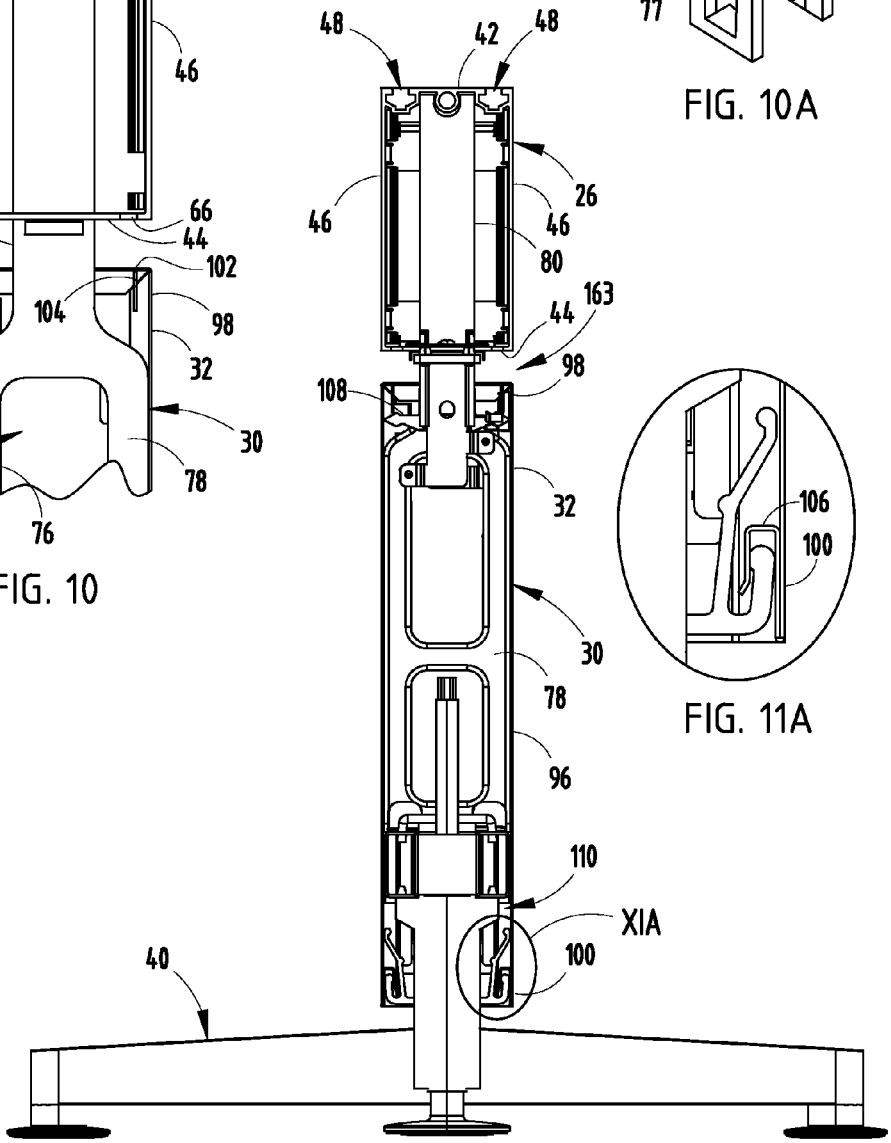
FIG. 11A
FIG. 11

PARTITION ASSEMBLY

CROSS REFERENCE TO RELATED APPLICATION

This application claims the benefit of U.S. Provisional Application No. 61/056,323, filed May 27, 2008, entitled PARTITION ASSEMBLY, which is hereby incorporated herein by reference in its entirety.

BACKGROUND OF THE INVENTION

The present invention relates to a partition assembly, and in particular to a highly reconfigurable partition assembly allowing optimization of a floor plan area and individual workstations within that floor plan.

SUMMARY OF THE INVENTION

One aspect of the present invention is to provide a beam assembly for subdividing a floor plan area that comprises a horizontally-extending beam member including an interiorly-facing surface, a bottom wall having at least one aperture extending therethrough, at least one horizontally-extending lower frame member located below the beam member, and at least one vertical frame member extending between and coupled with the beam member and the at least one lower frame member, wherein the at least one vertical frame member extends through the at least one aperture in the bottom wall of the beam member and interferingly engages the interiorly-facing surface of the beam member.

Another aspect of the present invention is to provide a beam assembly for subdividing a floor plan area comprising a horizontally-extending upper frame member defining an uppermost edge of a beam assembly, at least one horizontally-extending lower frame member located below the upper frame member, the lower frame member being the lowermost horizontally-extending frame member, and a plurality of vertical frame members extending between and coupling the upper frame member with the at least one lower frame member. The beam assembly further comprises a pair of cover members disposed on opposite sides of the vertical frame members, wherein each of the cover members extend from a first location in close proximity to the upper frame member to a second location located beneath the lower frame member, wherein the pair of cover members cooperate to form a wireway therebetween that is located below the lower frame member. Yet another aspect of the present invention is to provide a pair of the beam assemblies as described above in an end-to-end orientation, wherein the wireway between the pair of beam assemblies is uninterrupted.

Still another aspect of the present invention is to provide a beam assembly for subdividing a floor plan area that comprises a horizontally-extending beam member defining an upper edge of the beam assembly, at least one horizontally-extending lower frame member located below the upper frame member, and a plurality of vertical frame members extending between and coupling the upper frame member with the at least one lower frame member. The beam assembly further comprises a pair of cover members disposed on opposite sides of the vertical frame members, at least one of the cover members including an upper edge spaced from the beam member sufficiently to allow electrical communication lines to be routed between the upper edge of the at least one cover member and the beam member.

These and other advantages of the invention will be further understood and appreciated by those skilled in the art by reference to the following written specification, claims and appended drawings.

BRIEF DESCRIPTION OF THE DRAWINGS

FIG. 10 is an enlarged, partial end view of the beam assembly;

FIG. 10A is a perspective view of a grommet;

FIG. 11 is an end view of the beam assembly;

FIG. 11A is an enlarged view of area 11A, FIG. 11;

DETAILED DESCRIPTION OF THE PREFERRED EMBODIMENTS

Figure 4:
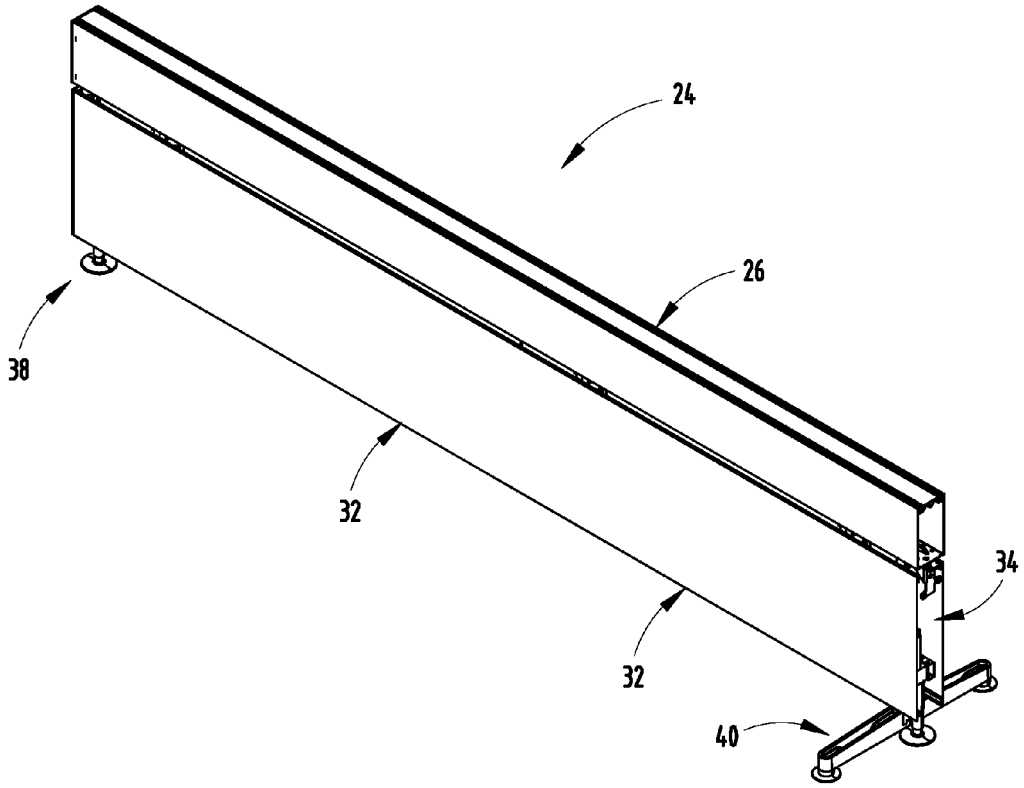
FIG. 4 is a perspective view of a beam assembly of the partition system.

For purposes of description herein, the terms "upper," "lower," "right," "left," "rear," "front," "vertical," "horizontal," and derivatives thereof shall relate to the invention as oriented in FIG. 4. However, it is to be understood that the invention may assume various alternative orientations and step sequences, except where expressly specified to the contrary. It is also to be understood that the specific devices and processes illustrated in the attached drawings, and described in the following specification are exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
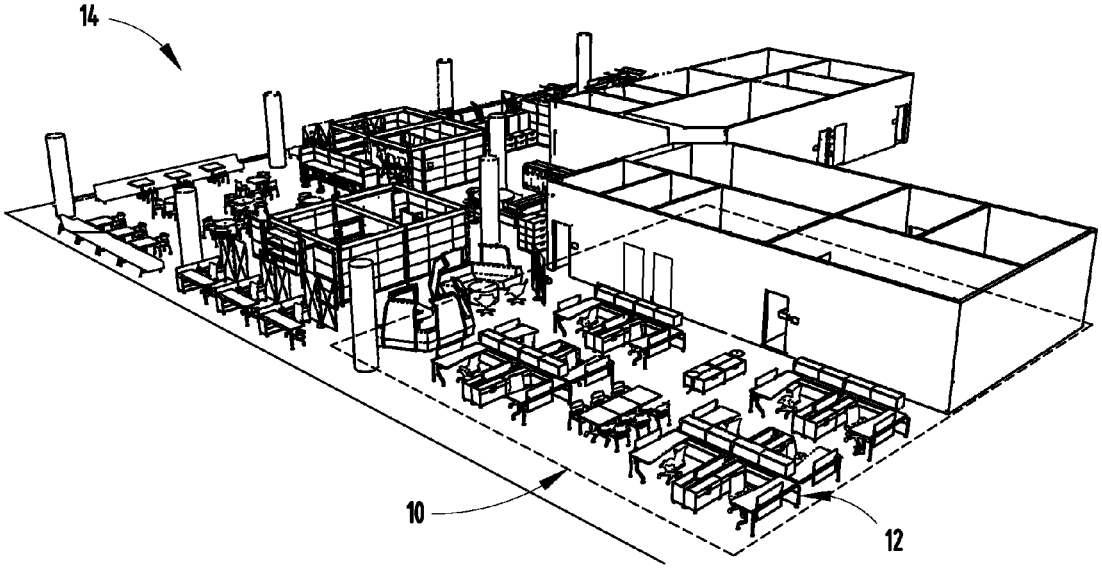
FIG. 1 is a perspective view of a floor plan area subdivided by a partition system embodying the present invention.
Figure 2:
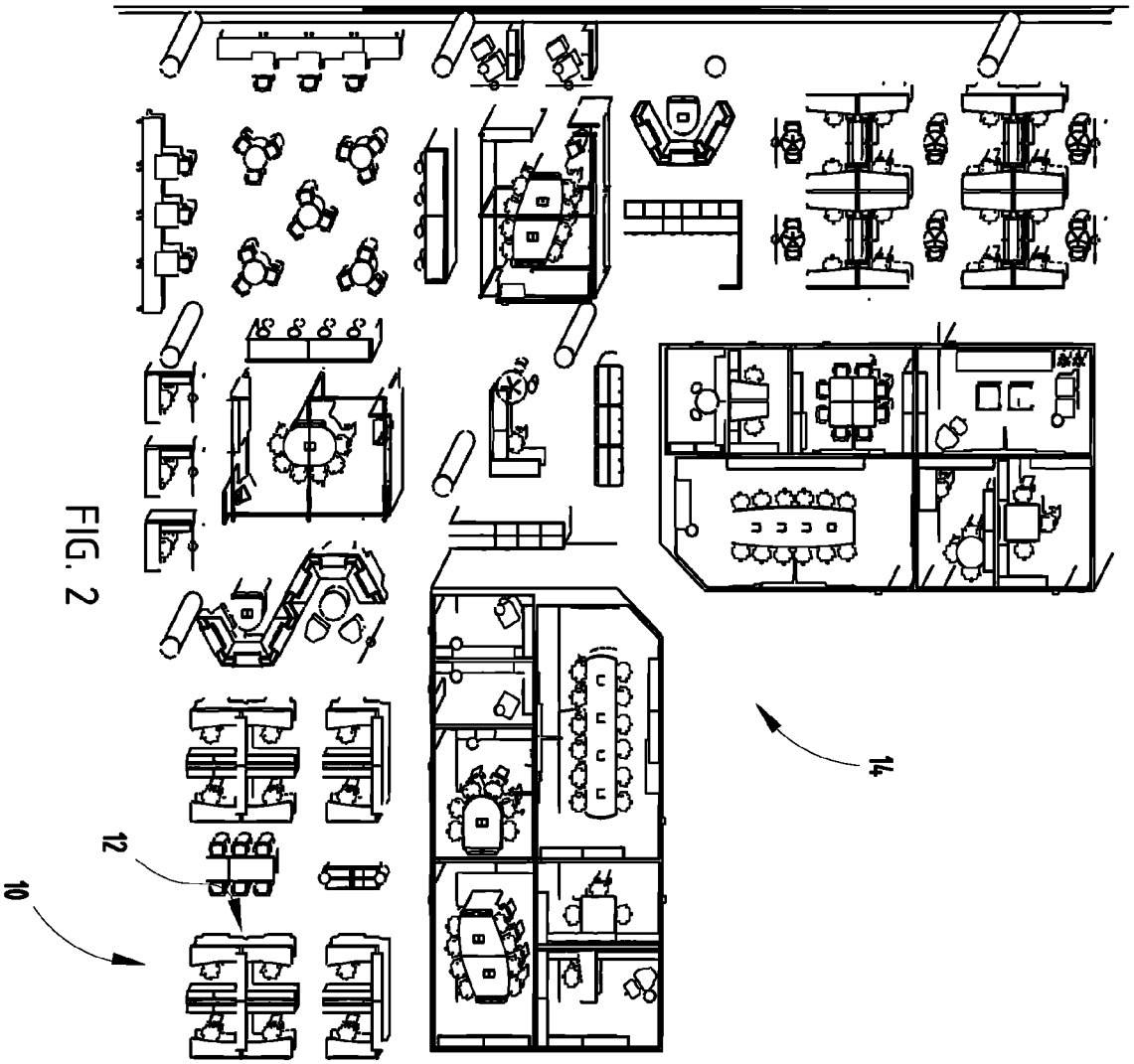
FIG. 2 is a top plan view of the floor plan area subdivided by the partition system.
Figure 3:
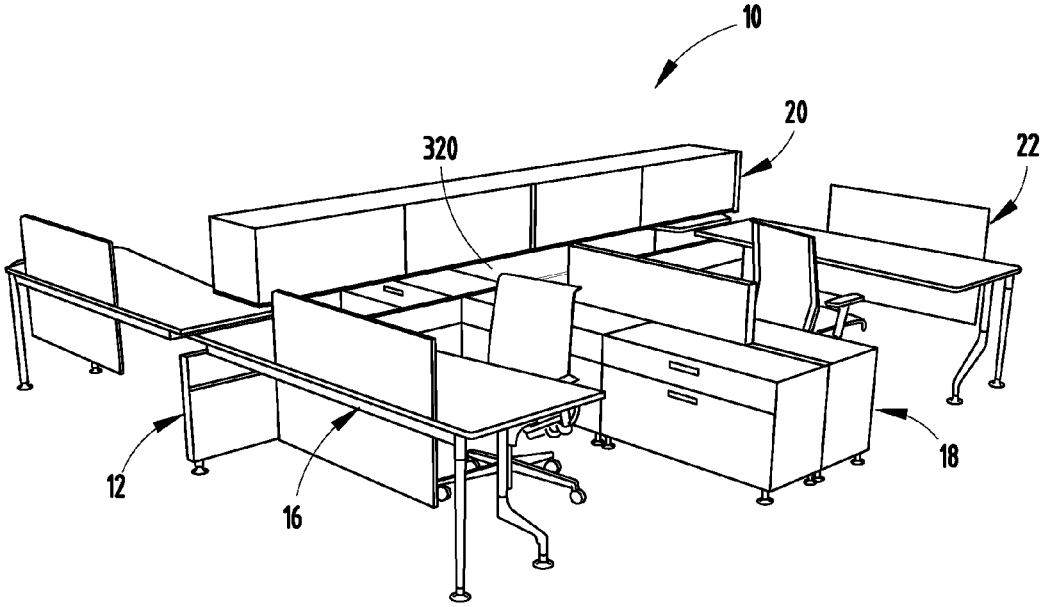
FIG. 3 is a perspective view of the partition system and a plurality of work tools supported therefrom.

Reference number 10 generally designates a furniture system (FIGS. 1 and 2) utilizing a partition assembly 12 embodying the present invention. The furniture system 10, and more particularly the partition assembly 12, is utilized to subdivide a given floor plan area 14 in an office environment either coupled with one another or as individual, stand-alone units. As best illustrated in FIG. 3, the furniture system 10 comprises the partition assembly 12 and a plurality of work tools that are supported by and/or extend outwardly from the partition assembly 12. In the illustrated example, the work tools include tables 16, lower storage units 18, elevated storage units 20, privacy screens 22, and the like. It is noted that while the illustrated example includes work tools that are coupled to and/or supported by the partition assembly 12, freestanding or stand alone work tools may also be incorporated within the furniture system 10 as described herein. It is further noted that the furniture system 10 is constructed and configured such that the lower storage units 18 are positioned with respect to the partition assemblies 12, and below a normal line of sight of a seated user, and are preferably positioned such that a top surface of such work tools are located even with or below an uppermost surface of each partition assembly 12. Moreover, work tools supported above the partition assembly 12, such as the elevated storage units and the privacy screens 22, are preferably configured such that an uppermost surface of each of these work tools is positioned below a normal line of sight of a user in a standing position. These configurations and orientations provide a relatively uninterrupted, both private and collaborative, work conducive environment.

Figure 5:
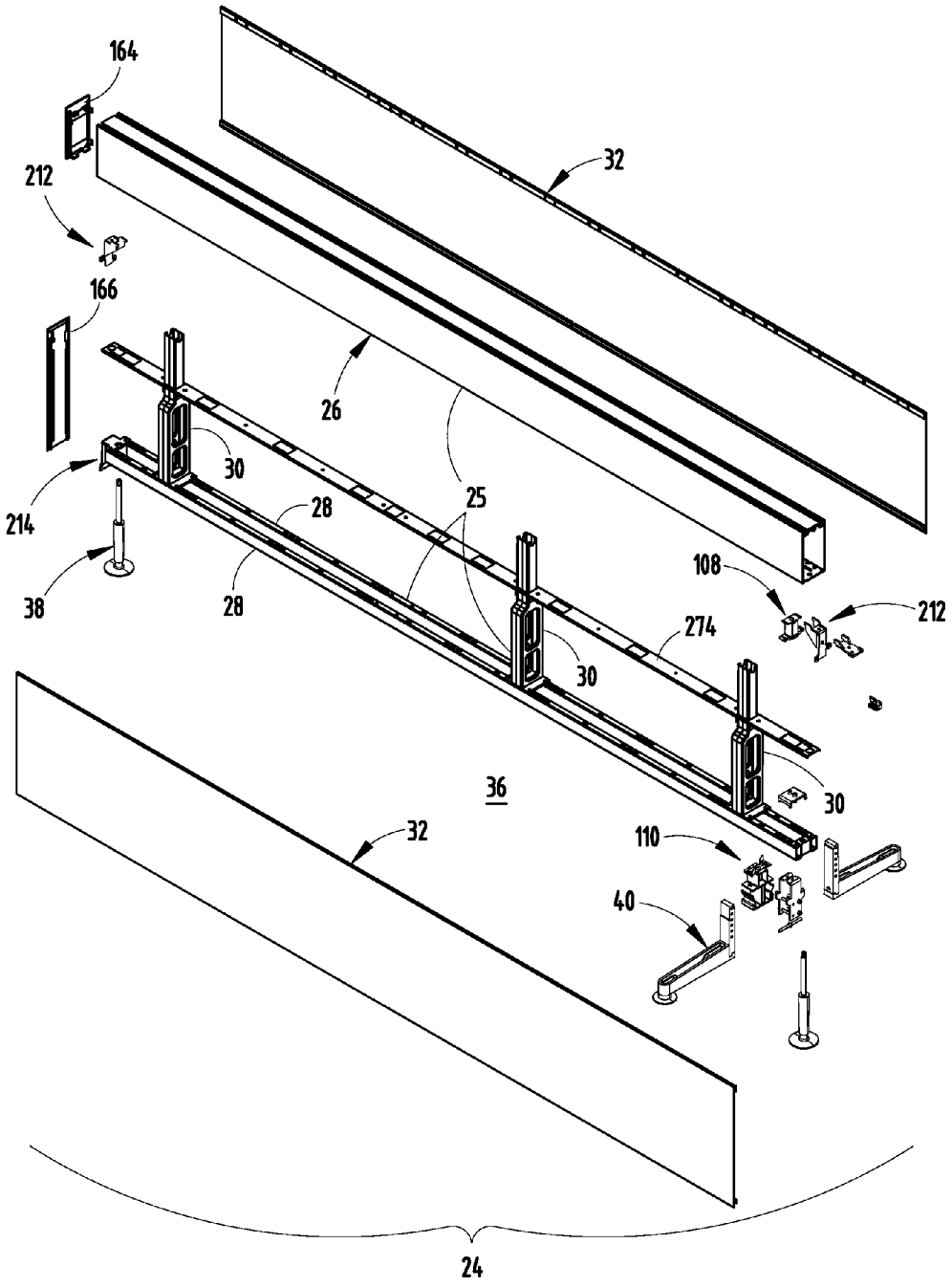
FIG. 5 is an exploded perspective view of the beam assembly.

The partition assembly 12 comprises a plurality of beam assemblies 24 (FIGS. 4 and 5) arranged and coupled with one another so as to subdivide and organize the floor plan area 14. Each beam assembly 24 comprises a frame assembly 25 that includes a horizontally-extending beam member 26, a pair of horizontally-extending lower frame members 28 spaced from one another and positioned below the beam member 26, and a plurality of vertical frame members 30 spaced along the length and coupling the beam member 26 and the lower frame members 28. Each beam assembly 24 further includes two cover members 32, which are juxtaposed from one another across the vertical frame members 30. The cover members cooperate with the frame assembly 25 to form an open wireway 34 extending along the entire length of the beam assembly 24 and adapted to allow the routing of electrical and/or communication lines therein. Each beam assembly 24 is supported above a floor surface 36 via two first foot assemblies 38 and one or more second foot assemblies 40 coupled with and extending downwardly from the lower frame members 28.

The beam member 26 (FIG. 6A) of each beam assembly 24 includes a top wall 42, a bottom wall 44 and a pair of sidewalls 46 that cooperate to form an elongated, rectangularly-shaped closed beam structure. The top wall 42 includes a pair of spaced apart channels 48 each extending along the length of beam member 26 and having a neck portion 50 and a receiver portion 52, wherein the width of the neck portion 50 is less than the width of the receiver portion 52. The receiver portion 52 includes a pair of sidewalls 54 extending orthogonally downward from the top wall 42, a bottom wall 56 extending substantially parallel with the top wall 42, and a pair of angularly-extending bottom walls 58 extending between the sidewalls 54 and the bottom wall 56. A circularly-shaped alignment tube 60 is located within the interior 47 of the beam member 26 and defines an aperture 62 that receives an alignment pin 64 therein that aligns adjacent beam members 26 within the partition assembly 12. Alternatively, the alignment tube 60 (FIG. 6B) may include a longitudinally-extending opening 65. The bottom wall 44 includes a plurality of circularly-shaped work tool apertures 66 (FIG. 7) spaced along the length of the beam member 26. In the illustrated example, the work tool apertures 66 are provided in a pair of rows located proximate the sidewalls 46 and they are adapted to receive work tools supporting assemblies therein, as discussed below, and 90° beam connections, wherein beam assemblies 24 are coupled to one another in original orientations. The bottom wall 44 of each beam member 26 further includes a plurality of rectangularly-shaped vertical frame member apertures 68 spaced along the length of the beam member 26. It is noted that the beam member 26 is preferably formed via an extrusion process, however, other suitable methods of manufacture may be utilized.

Figure 8A:
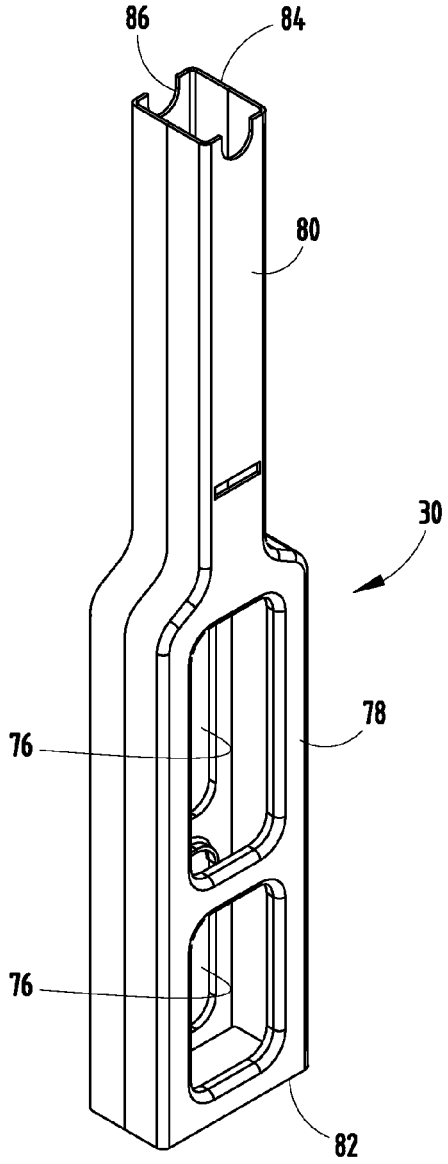
FIG. 8A is a perspective view of a vertical frame member of the beam assembly.
Figure 8B:
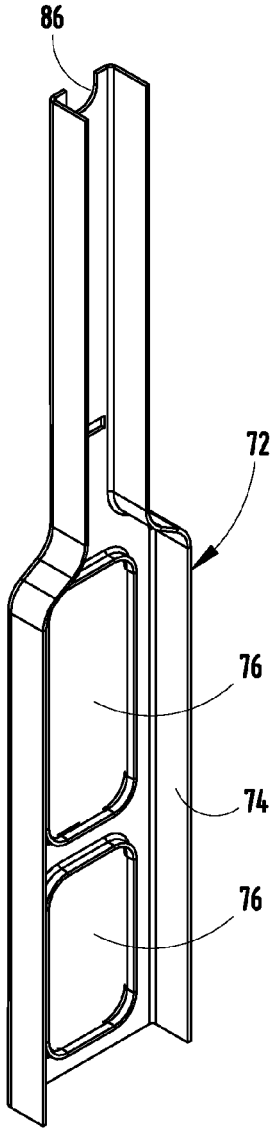
FIG. 8B is a perspective view of a portion of the vertical frame member.

As best illustrated in FIGS. 8A and 8B, each vertical frame member 30 comprises two halves 72 each having a pair of sidewalls 74 each being resistance welded with a corresponding opposite half 72. Each vertical frame member includes a pair of apertures 76 extending therethrough and adapted to receive electrical and communication wire routing. In the illustrated example, each vertical frame member 30 includes a lower portion 78 that includes the apertures 76 and a necked-down upper portion 80. Each vertical frame member 30 further includes a lower end 82 and an upper end 84. The upper end 84 includes a pair of arcuately-shaped recesses 86.

Figure 9:
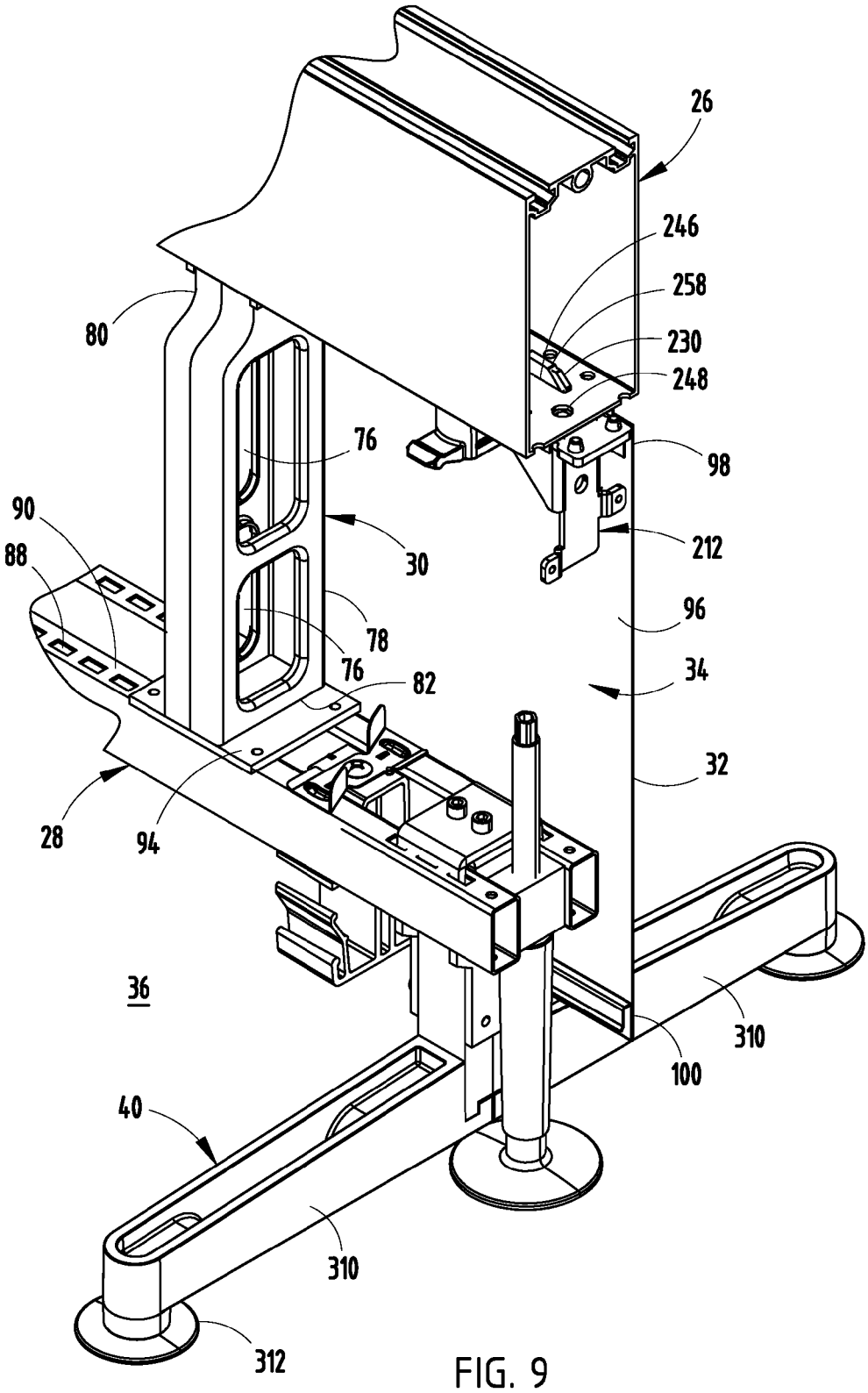
FIG. 9 is a partial perspective view of the beam assembly with the cover removed therefrom to show interior components thereof.
Figure 29A:
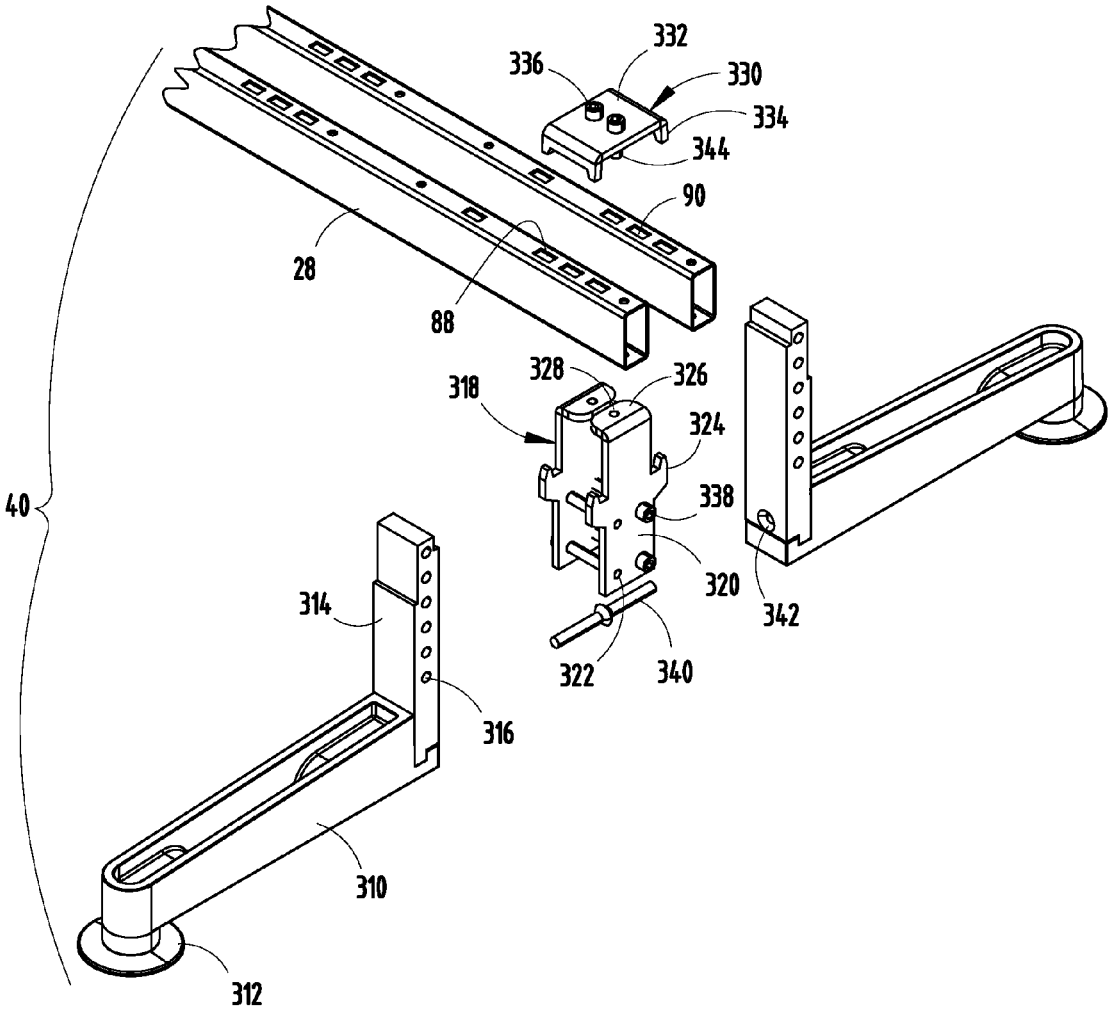
FIG. 29A is an exploded perspective view of a second foot assembly.
Figure 29B:
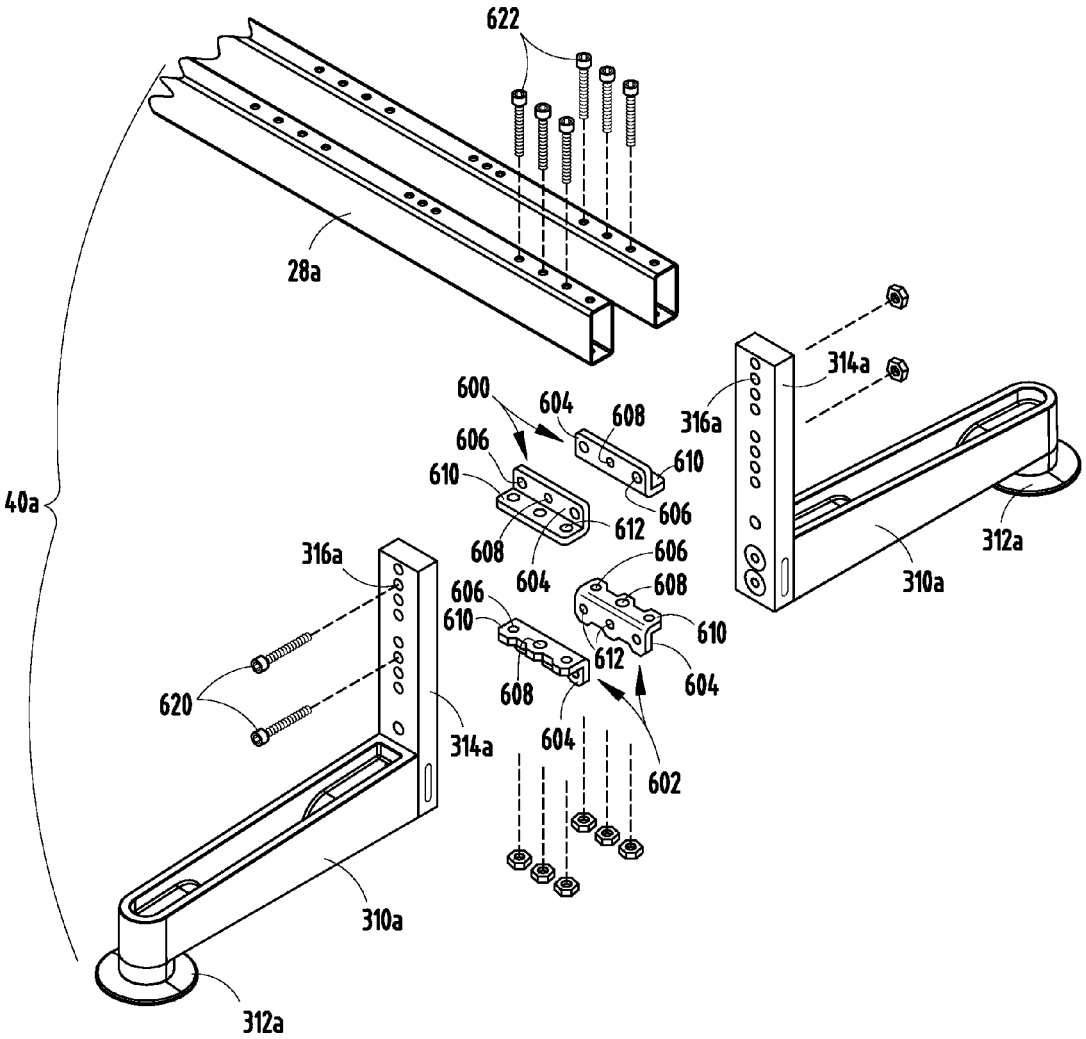
FIG. 29B is an exploded perspective view of an alternative embodiment of the second foot assembly.
Figure 30:
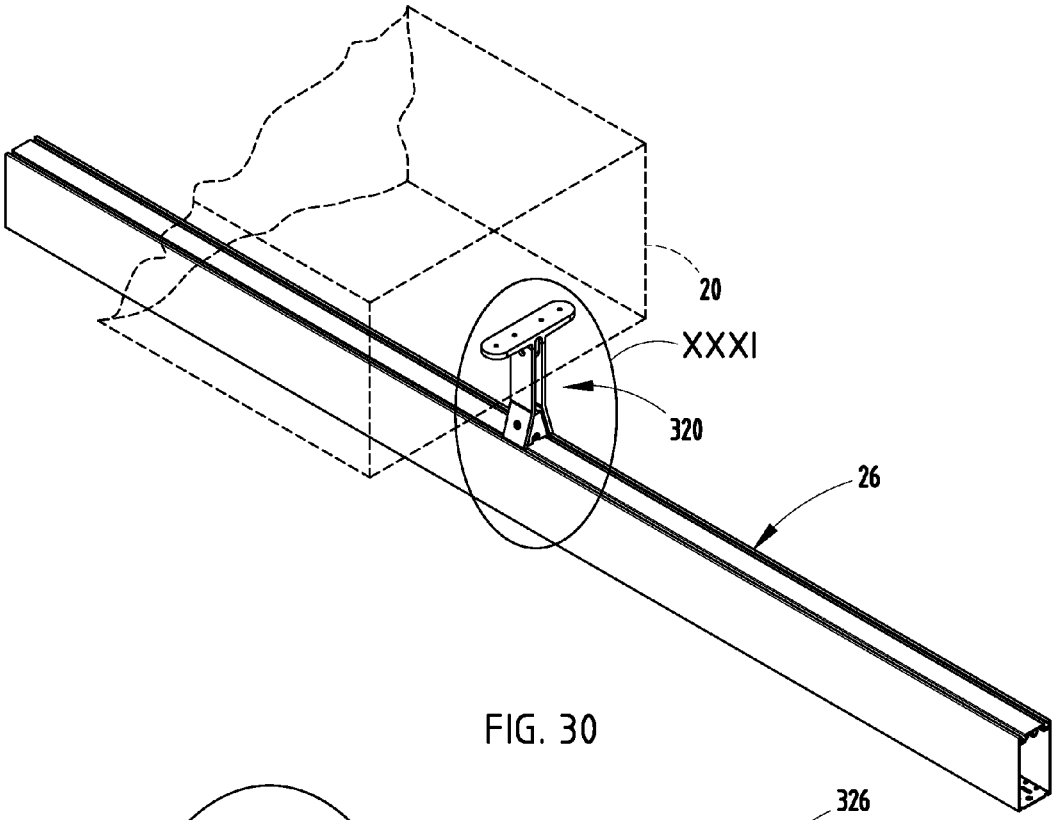
FIG. 30 is a perspective view of storage unit supported above the beam by a stanchion assembly, wherein the storage unit is drawn in phantom.
Figure 31:
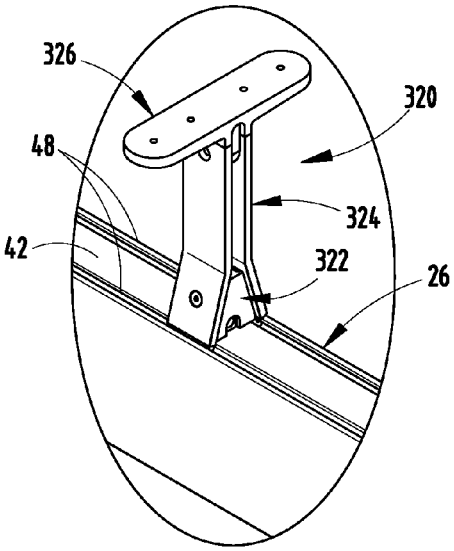
FIG. 31 is an enlarged view of area 28, FIG. 30, illustrating the beam and the stanchion assembly.
Figure 32:
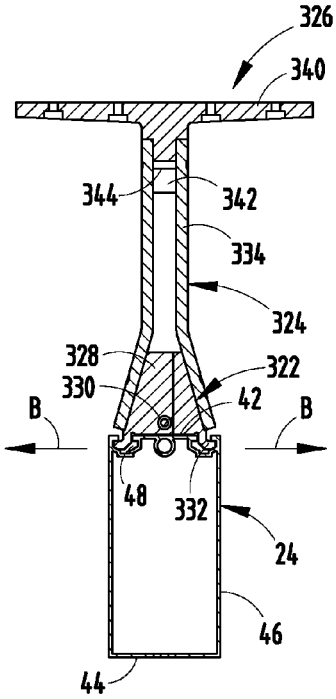
FIG. 32 is an end view of the beam member supporting the stanchion assembly and a worksurface support assembly therefrom, with a supported worksurface shown at two adjustable heights.

Each of the lower frame members 28 (FIG. 9) are provided a rectangular cross-sectional configuration and include a plurality of rectangular-shaped apertures 88 located within and spaced along the length of an upper or top surface 90, or alternatively circular-shaped aperture as illustrated in FIG. 29B. Each of the lower frame members 28 are preferably formed via a roll form process, however, other suitable forms of manufacture may be utilized. Further, each vertical frame member 30 may be constructed by weldably securing each of the two halves 72 in a back-to-back relationship.

Figure 6A:
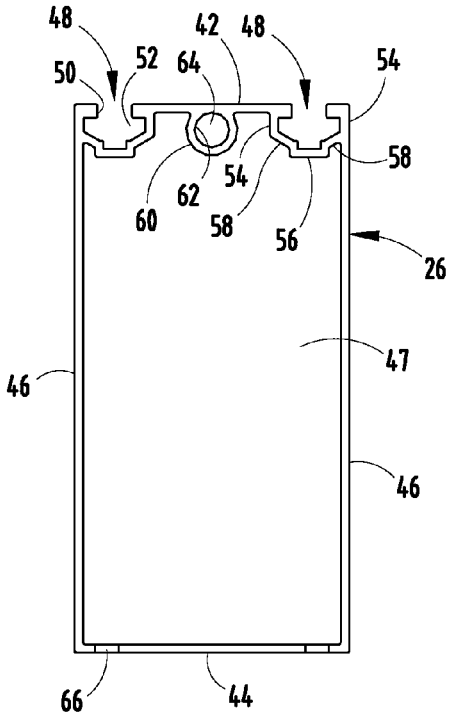
FIG. 6A is an end view of a beam of the beam assembly.
Figure 6B:
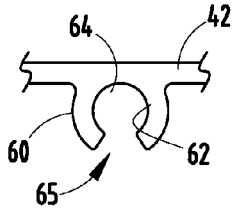
FIG. 6B is a partial end view of an alternative embodiment of an end portion of the beam.
Figure 7:
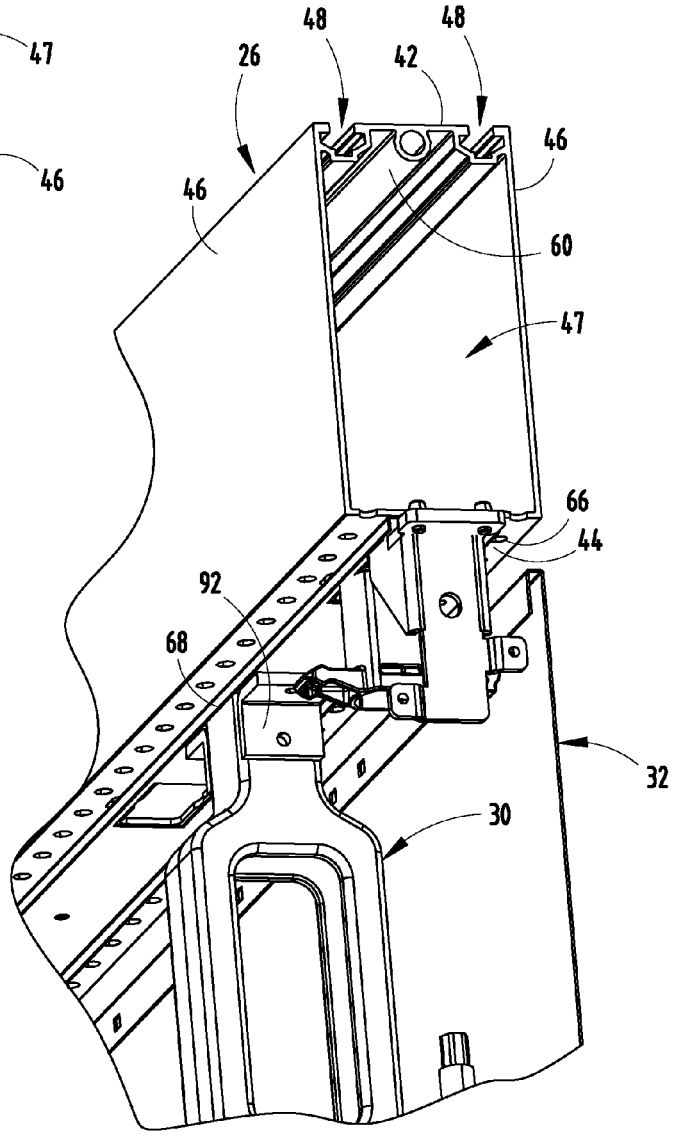
FIG. 7 is a partial perspective view of the beam assembly with a cover member of the beam assembly removed to show interior components thereof.
Figure 8C:
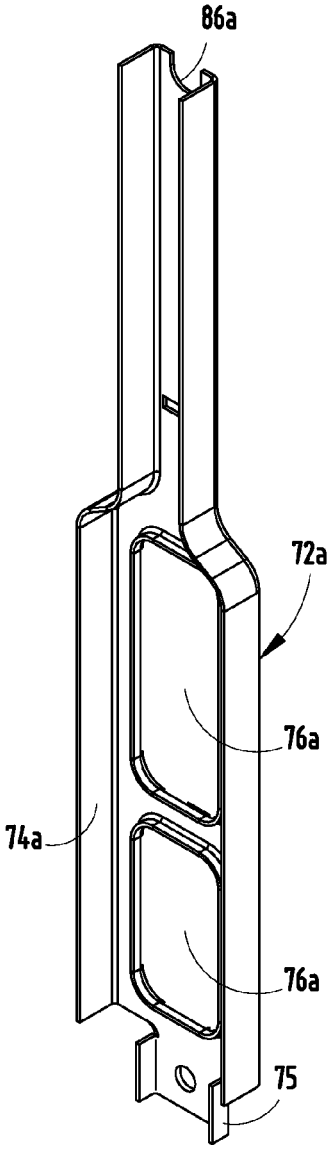
FIG. 8C is a perspective view of an alternative embodiment of the portion of the vertical frame member.

In assembly, each of the vertical frame members 30 is positioned such that the upper portion 80 of each of the vertical frame members 30 extends through the corresponding vertical frame member aperture 68 of the beam member 26. As best illustrated in FIG. 10, the upper end 84 of each of the vertical frame members 30 cooperates with the interior surface of the top wall 42 of the beam member 26 to form an interference fit between the vertical frame member 30 and the beam member 26. Alternatively, a grommet 73 (FIG. 10A) is located between the top end of the vertical frame member 30, when created the two halves 72 in a back-to-back relationship, and the beam 26 to reduce sounds caused by frictional engagement therebetween. The grommet 73 includes an arcuately-shaped body portion 75 that is received within the recesses 86, and a pair of engagement legs 77 that engage along a length of the vertical frame member 30. The grommet 73 preferably comprises a plastic or rubber material. In the illustrated example, the alignment tube 60 is received within the recesses 86 of the vertical frame member 30 with the upper end 84 of the vertical frame member 30 being received between the alignment tube 60 and the sidewalls 54 of channels 48. A pair of L-shaped coupler brackets 92 (FIG. 7) are then secured to each side of the corresponding vertical frame member 30 via a plurality of mechanical fasteners (not shown) and the bottom wall 40 of the beam member 26 by a plurality of mechanical fasteners 93 (FIG. 6A). The lower end 82 of each of the vertical frame members 30 is secured to the lower frame members 28 via a planar coupler bracket 94 (FIG. 9) that is weldably secured to the lower end 82 of the corresponding vertical frame member 30 and secured to the lower frame members 28 via a plurality of mechanical fasteners (not shown). Alternatively, the lower end 82 of each of the vertical frame members 30 may be weldably secured directly to the lower frame members 28. As best illustrated in FIG. 8C, each vertical member 30 may include a downwardly-extending C-shaped tab member 75 that may be weldably-secured to the lower frame members 28.

Figure 12:
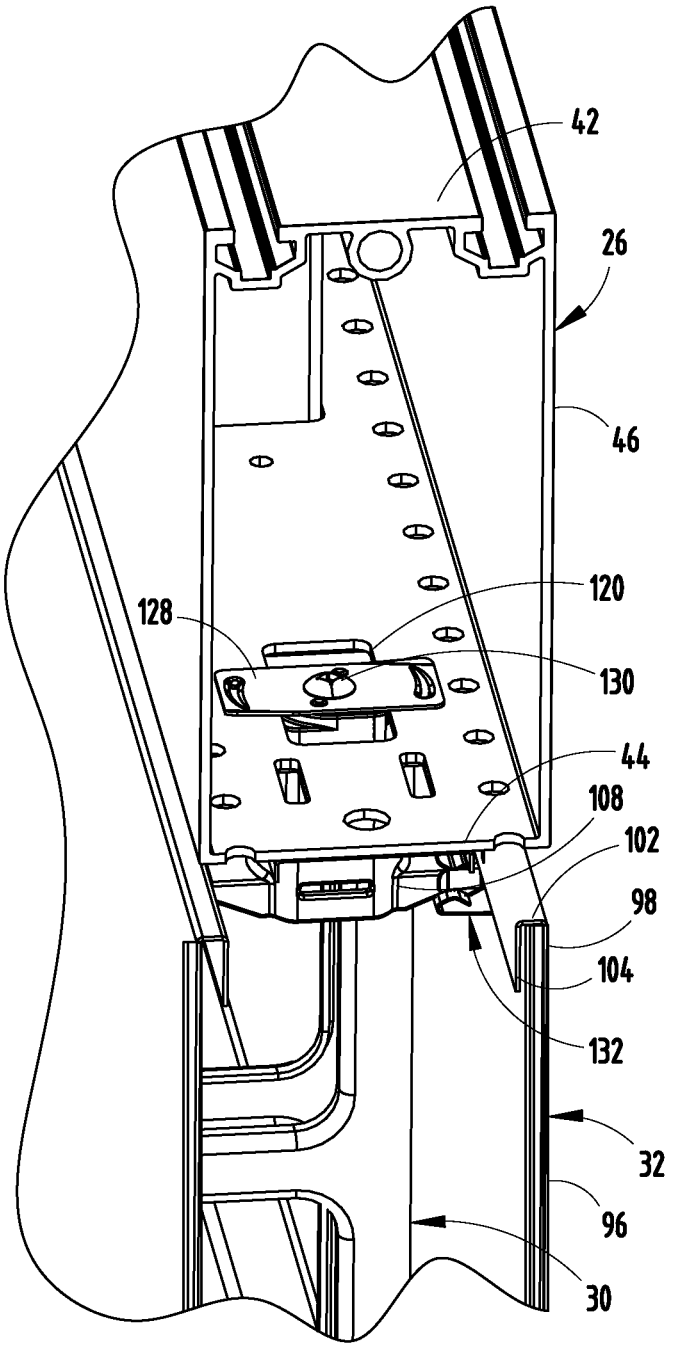
FIG. 12 is an enlarged, partial perspective view of the beam assembly.
Figure 13A:
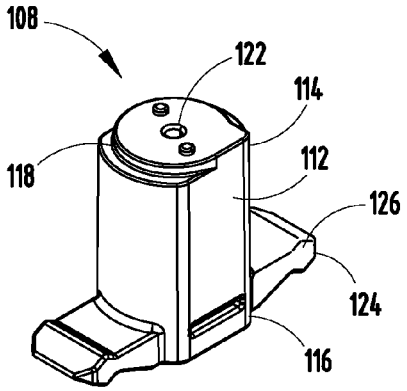
FIG. 13A is a perspective view of a first hanger member.
Figure 13B:
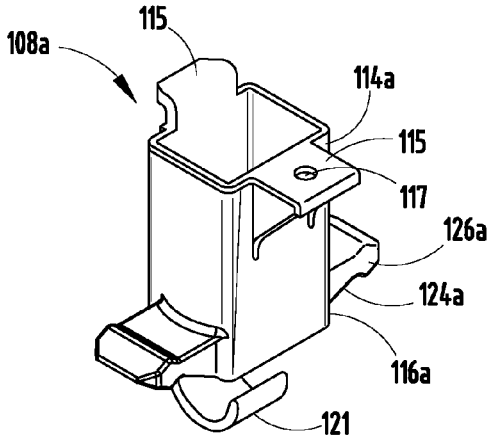
FIG. 13B is a perspective view of an alternative embodiment of the first hanger.
Figure 14A:
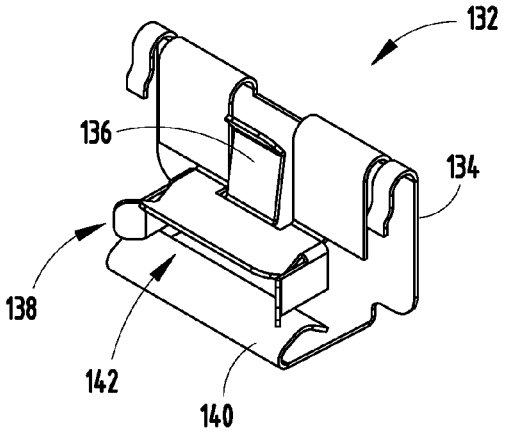
FIG. 14A is a perspective view of a clip member.
Figure 14B:
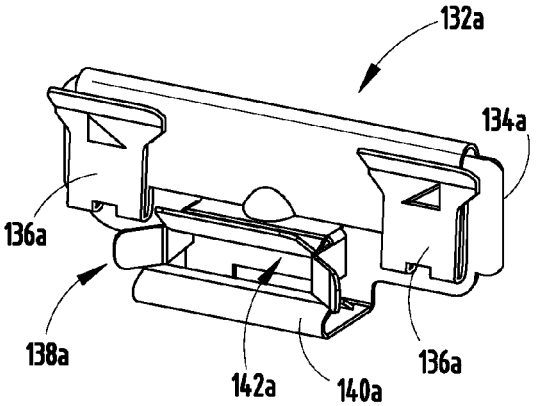
FIG. 14B is a perspective view of an alternative embodiment of the clip member.

Each cover or skin member 32 (FIG. 11) includes a planar body portion 96, an upper edge 98 and a lower edge 100. The upper edge 98 includes a downwardly-opening C-shaped channel having un upper edge 102 (FIG. 12) extending orthogonal to the body portion 96, and a downwardly-extending lip 104 extending substantially parallel with the body portion 96. The lower edge 100 of each of the cover members 32 includes a longitudinally-extending downwardly-opening hook portion 106 (FIG. 11A). Each of the cover members 32 is supported on the overall beam assembly 24 by an upper support member 108 and a lower support member 110. The upper support member 108 (FIGS. 12 and 13A) includes a tubularly-shaped body portion 112 having an upper end 114 and a lower end 116. The upper end 114 includes a raised cam-surface 118 that engages a rectangularly-shaped cover member support aperture 120 extending through the bottom wall 44 of the beam member 26. The upper end 114 further includes a centrally-located mechanical fastener-receiving aperture 122. The lower end 116 includes a pair of outwardly-extending legs 124 each having a bulbous outer end 126. The legs 124 cooperate with the body portion 112 to provide the upper support member 108 with an inverted T-shape. The upper support member 108 further includes a latch member 128 rotatably coupled to the upper end 114 of the body portion 112 via a screw 130 that is received with the aperture 122. In operation, the latch member 128 is movable between a first position wherein the latch member 128 is aligned with the corresponding rectangular shape of the cover member support aperture 122, and a second position, as illustrated in FIG. 12, wherein the latch member 128 supports the upper support member 108 from the bottom wall 144 of the beam member 26. Alternatively, the upper support member 108*a* (FIG. 13B) includes a rectangularly-shaped body portion 112 having an upper end 114*a* and a lower end 116*a*. The upper end 114*a* includes a pair of outwardly-extending support arms 115*a*, 115*b*, wherein one of the arms 115*b* include an aperture 117 extending therethrough. The lower end 116*a* includes a pair of outwardly-extending legs 124*a* each having a bulbous outer end 126*a*. The legs 124*a* cooperate with the body portion 112*a* to provide the upper support member 108*a* with an inverted T-shape. In assembly, the upper support member 108*a* is coupled with the beam assembly 26 by inserting leg 115*a* into the aperture 120 of the beam 28, such that the leg 115*a* is supported by the lower wall 44 of the beam 28, and securing the other leg 115*b* to the beam 28 by inserting a mechanical fastener such as a screw (not shown) through the aperture 117. The upper support member 108*a* further includes an integrally formed, downwardly-extending, hook-shape wire support 121 adapted to support electrical and communication lines. A plurality of cover mounting clips 132 (FIG. 14A) are spaced along the length of the upper edge 98 of a corresponding cover member 32 and engage both the upper edge 98 and the upper support member 108 to couple the associated cover member 32 within the overall beam assembly 24. Specifically, the clip 132 includes an elongated body portion 134 having an oval cross-sectional configuration, a flexibly resilient tab 136 extending substantially planar with the body portion 134, a guide 138 extending substantially orthogonally to the body portion 134 and a flexibly resilient spring portion 140 extending parallel with the guide 138 and spaced slightly therefrom. Alternatively, the clip 132*a* (FIG. 14B) includes a pair of flexibly resilient tabs 136*a* spaced across the body portion 134 from one another.

In assembly, the body portion 134 of each of the clips 132 is positioned between the lip 104 and the body portion 96 of the associated cover member 32 while the lip 104 is captured between the tab 136 and the body portion 134 of the clip 132, while tabs A engage into cover apertures, thereby securing the clip 132 with the cover member 32. In the illustrated example, the guide 138 includes a plurality of bent tabs that cooperate to form a rectangularly-shaped receiving cavity 142 that receives an end 126 of one of the legs 124 of the upper support member 108 therein, while the spring portion 140 is biased against an opposite side of the end 126 of the leg 124, thereby releasably securing the clip 132 and the associated cover member 32 with the overall beam assembly 24.

Figure 15:
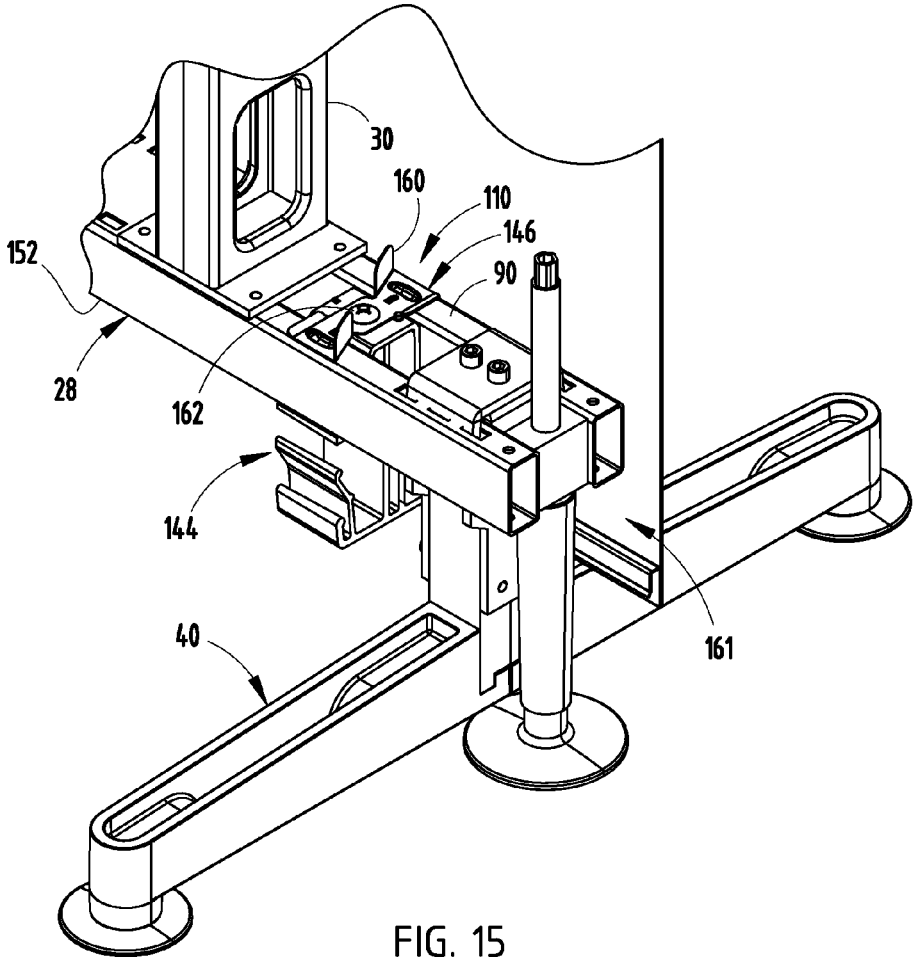
FIG. 15 is an enlarged partial perspective view of the beam assembly with the cover removed to show the interior components thereof.
Figure 16A:
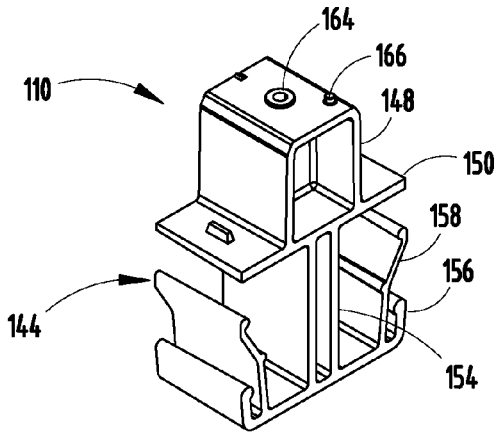
FIG. 16A is a perspective view of a second hanger member.
Figure 16B:
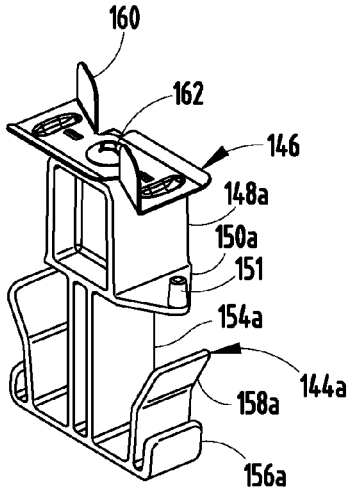
FIG. 16B is a perspective view of an alternative embodiment of the second hanger member.

As best illustrated in FIGS. 15 and 16A, the lower support member 110 includes a support 144 and a latch member 146. The support 144 includes an upper portion 148 that is received between the pair of lower frame members 28, a pair of abutment members 150 that extend outwardly from the upper portion 148 and abut a lower surface 152 of a corresponding lower frame member 28, a lower portion 154 extending downwardly from the upper portion 148, a cover supporting arm 156 spaced outwardly from the lower portion 154, and a wire guide arm 158 spaced outwardly from the lower portion 154 and inwardly from the cover support arm 156. In assembly, support 144 is held in position with respect to the lower frame members 28 by the latch member 146 that is movable between an assembly position, wherein the rectangularly-shaped latch member 146 is aligned with the space extending between the pair of lower frame members 28, and a latched position, wherein the latch member 146 extends orthogonal to the lower frame members 28 and abuts the upper surface 90 thereof. The latch member 146 includes a pair of upwardly-extending finger tabs 160 configured so as to allow the user to easily move the tab member between the assembly and latched positions. The latch member 146 is rotatably secured to the upper portion 148 of the support 144 by a screw 162 that extends into an aperture 164 of the support 144. A stop member 166 extends upwardly from the upper portion 148 of the support 144 and prevents over rotation of the latch member 146 with respect thereto. Each of the cover supporting arms 156 extends outwardly from the lower portion 154 and receives the hook portion 106 of the lower edge 100 of the associated cover panel 32 thereon, thereby positioning the cover member 32 from the lower support member 110. The wire guide arm 158 cooperates with the lower portion 154 to support electrical and communication lines therebetween. Specifically, the lower support member 110 assists in supporting electrical/communication lines running with a lower wireway 161 defined between the pair of covers 32 and located below the lower frame members 28, illustrated as the lowermost horizontally-extending frame member of the frame assembly 25. It is noted that the wireway 161 is also adapted to house power blocks and adapters therein. It is further noted that both the wireway 161 as well as the wireway 34 extend uninterrupted between adjacent beam assemblies 24. Alternatively, the lower support member 110*a* (FIG. 16B) includes triangularly-shaped abutment members 150 each having an upwardly-extending pin 151 that is received within one of the corresponding apertures 88.

Each cover member 32 is assembled with the overall beam assembly 24 by placing the hook portion 106 of the lower edge 100 of the cover member into engagement with the cover support arm 156 of each of the corresponding lower support members 110 and then rotating the upper edge 98 of the cover member 32 inwardly toward the vertical frame members 30 until the clips 132 releasably engage the legs 124 of the associated upper support members 108. Once assembled, the top edge 98 of each cover member 32 cooperates with the bottom wall 44 of the beam 26 to form a wire routing gap 163 (FIG. 11) therebetween. The wire routing gap 163 allows the passage of wires between the covers 32 and the beam 26 and communication and electrical lines to be easily routed from the wireways 34, 161 to a location in close proximity to the user. In the illustrated example, the gap 163 is approximately ⅞ inch in width and runs along the entire length of the beam assembly 24, however, other widths and length may be utilized depending on a particular application or requirement.

Figure 17:
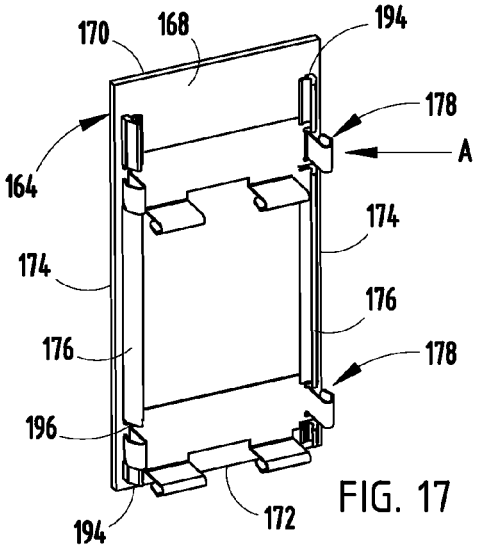
FIG. 17 is a perspective view of an upper end cover member.
Figure 18:
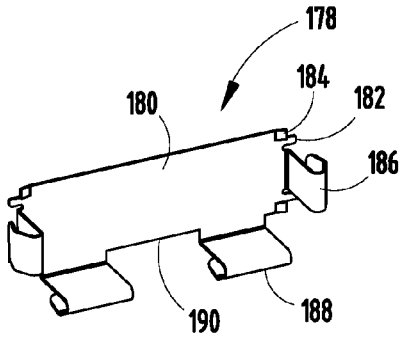
FIG. 18 is a perspective view of a clip member utilized to support the upper end cover member.

Each beam assembly 24 that is positioned at an end of a total partition assembly 12 is provided with end cover or skin members including a top end cover 164 (FIG. 5) that covers and end of the associated beam member 26, and a bottom end cover 166 that covers the wireway 34. The top end cover 164 (FIG. 17) includes a panel portion 168 having a top edge 170 and a bottom edge 172 that align with the top wall 42 and the bottom wall 44 of the beam member 26, respectively, when the top end cover 164 is secured to the beam member 26. The panel portion 168 further includes side edges 174 each having an inwardly turned channel 176 utilized to secure a clip member 178 thereto. The clip member 178 (FIG. 18) includes a planar body portion 180, pairings of alignment tabs 182 extending outwardly from side edges 184 of the body portion 180, a first pair of flexibly resilient spring arms 186 positioned between the pairings of alignment tabs 182 and extending orthogonally inward from the body portion 180, and a second pair of spring tabs 188 extending from another side edge 190 and orthogonally from the body portion 180. In assembly, a pair of the clip members 178 are each coupled with the top end cover 168 by locating the alignment tabs 182 of each of the clip members 178 within the channels 176 of the top end cover 164. During the sliding assembly motion, the first pair of spring arms 186 of the associated clip member 178 are pressed in an inward direction A such that the arms 186 may pass by the ends 194 of the channels 176. Multiple gaps 196 located along the length of the channels 176 receive the first pair of spring arms 186, thereby allowing the spring arms 186 to flex in an outward direction and secure the position of the clip members 178 along the length of the top end cover 164. The top end cover 164 is assembled with the beam member 26 by aligning the top end cover 164 with an end of the beam member 26 such that the tabs 186 and 188 of the clip members 178 are received within the interior 47 of the beam member 26. Specifically, the clip members 178 are aligned with the beam member 26 such that the first pair of spring arms 186 of each of the clip members 178 frictionally engages an inner surface of the sidewalls 46 of the beam member 26, while the second pair of spring tabs 188 of the upwardly-located clip member 178 abuts an inner surface of the bottom wall of the channels 48 and the second pair of spring arms 188 of the downwardly located clip member 178 abuts an inner surface of the bottom wall 44 of the beam member 26.

Figure 19:
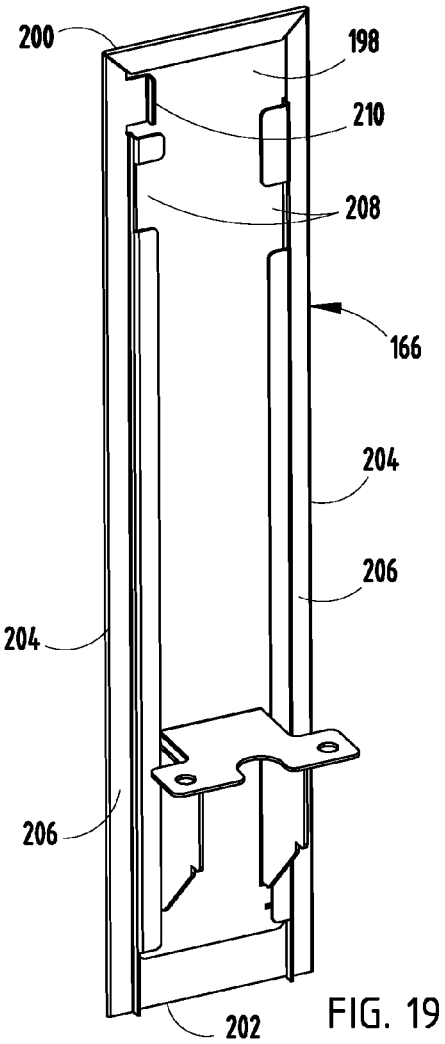
FIG. 19 is a perspective view of a lower end cover member.
Figure 20A:
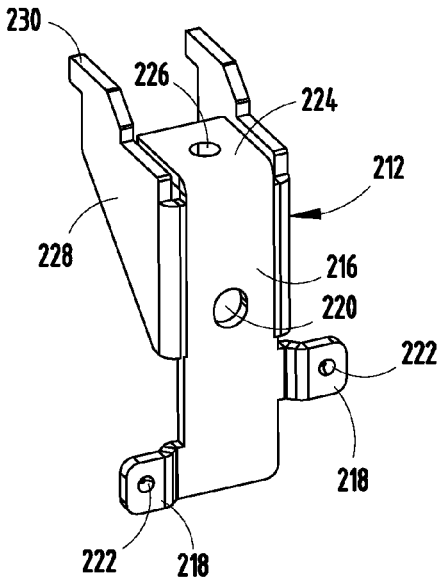
FIG. 20A is a perspective view of a coupler bracket.
Figure 20B:
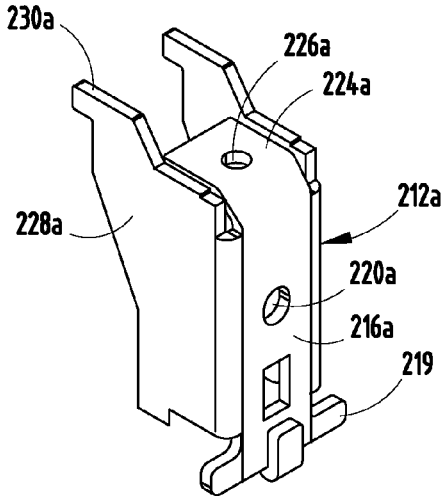
FIG. 20B is a perspective view of an alternative embodiment of the coupler bracket.
Figure 24:
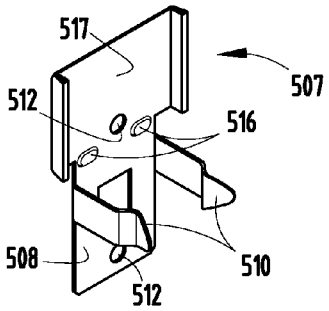
FIG. 24 is a perspective view of an alternative embodiment of the upper attachment bracket.

In a first embodiment, the bottom end cover 166 (FIG. 19) includes a body portion 198 having a top edge 200 and a bottom edge 202 that align with the upper edge 98 and lower edge 100 of the cover members 32, respectively, when the bottom end cover 166 is secured to the overall beam assembly 24. The body portion 198 further includes a pair of side edges 204 each including an inwardly-opening channel 206 extending along the length of the bottom end cover 166. Each of the channels 206 includes a gap 208 located along the length thereof while receiving a support structure therein, as described below. One of the channels 206 further includes an inwardly-extending stop tab 210. The bottom end cover 166 is attached to the overall beam assembly 24 via an upper coupler bracket 212 (FIG. 5) and a lower coupler bracket 214. The upper coupler bracket 212 (FIG. 20A) includes a planar body portion 216 having a pair of arms 218 extending from opposite sides of the body member 216 and staggered from one another along the length of the body portion 216. In the illustrated example, the body portion 216 includes an aperture 220 extending therethrough while each of the arms 218 include raised features 222. The upper coupler bracket 212 also includes a top wall 224 extending orthogonally from the body portion 216 and having an aperture 226 extending therethrough. The upper coupler bracket 212 further includes a pair of angled sidewalls 228 ending in a pair of tabs 230 extending upwardly from the top wall 224. In an alternative embodiment, as best illustrated in FIG. 20B, an upper coupler bracket 212*a* is similar in construction to the upper coupler bracket 212 with the main exception being the replacement of the pair of offset arms 218 with a pair of aligned arms 219 that are releasably engaged by spring arms 510 (FIG. 24) of a clip member 507, as described below.

Figure 21:
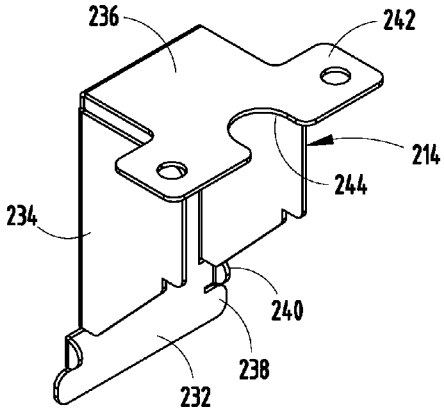
FIG. 21 is a perspective view of an attachment bracket utilized to connect the lower end cover member to the overall beam assembly.

The lower coupler bracket 214 (FIG. 21) includes a planar body portion 232, a pair of sidewalls 234 extending orthogonally from the body portion 232, and a top wall 236 extending orthogonally from the body portion 232. The body portion 232 includes a pair of alignment tabs 238 extending outwardly from a lower portion of the body portion 232, a pair of securement tabs 240 extending outwardly and orthogonally from the body portion 232, and located between the sidewalls 234 and the alignment tabs 238 along the length of the body portion 232. The top wall 236 includes a pair of outwardly-extending support tabs 242 bifurcated by an arcuately-shaped relief 244.

Figure 22:
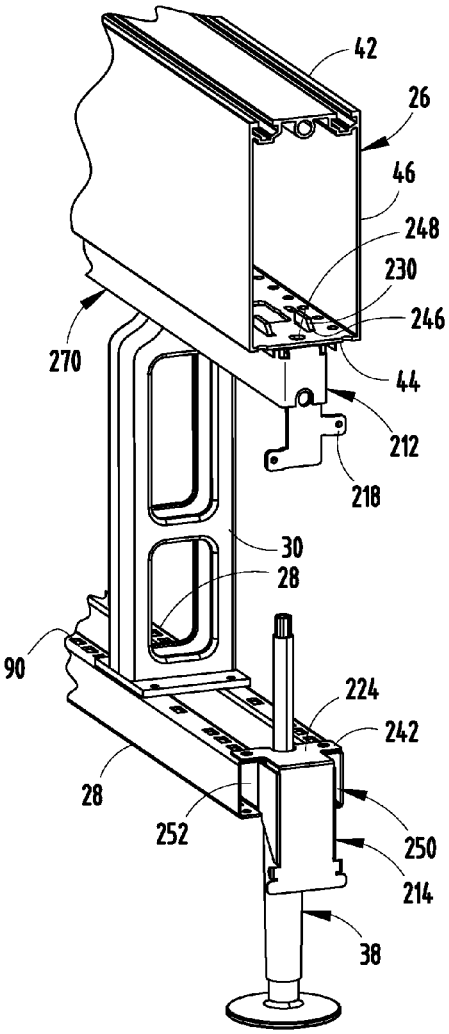
FIG. 22 is a partial perspective view of the beam assembly with both cover members removed to show interior components thereof.

In assembly, the upper coupler bracket 212 (FIG. 22) is assembled with the beam member 26 by extending the tabs 230 of the upper coupler bracket 212 into corresponding apertures 246 located within the bottom wall 44 of the beam member 26 and securing the upper coupler bracket 212 via a mechanical fastener, such as a bolt, extending through an aperture 248 located within the bottom wall 44 of the beam member 26 and the aperture 226 located within the top wall 224 of the upper coupler bracket 212. The lower coupler bracket 214 is assembled to the frame assembly 25 by aligning the lower coupler bracket 214 with the lower frame members 28, such that the sidewalls 234 of the lower coupler bracket 214 is received within the interior 250 of the corresponding frame members 28 and guide along the respective interior walls 252 thereof, while the support tabs 242 of the top wall 224 are proximal to and secured to the upper surface 90 of the each of the lower frame members 28 via mechanical fasteners such as bolts or screws (not shown). The bottom end cover 166 is then secured to the overall beam assembly 24 by sliding the channels 206 of the bottom end cover 166 into engagement with the arms 218 of the upper coupler bracket 212 and the securement tabs 240 of the lower coupler bracket 214. The alignment tabs 238 of the lower coupler bracket 214 serve to align and guide the bottom end cover 166 as it is slidably assembled with the brackets 212, 214, while the stop tab 210 of the bottom end cover 224 abuts the upper coupler bracket 212, thereby vertically aligning the bottom end cover 166 with the overall beam assembly 24. The arcuately-shaped relief 244 within the top wall 236 of the lower coupler bracket 214 provides clearance for the first foot assembly 38.

Figure 23:
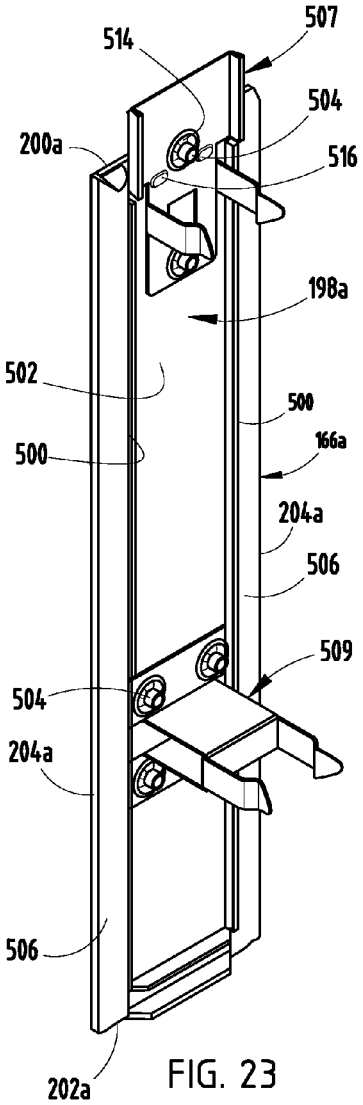
FIG. 23 is a perspective view of an alternative embodiment of the lower end cover member.
Figure 25:
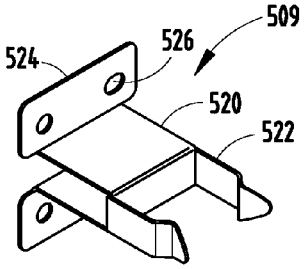
FIG. 25 is a perspective view of an alternative embodiment of the lower attachment bracket.

In a second embodiment, the bottom end cover 166*a* (FIG. 23) includes a body portion 198*a* having a top edge 200*a* and a bottom edge 202*a* that align with the upper edge 98 and lower edge of the cover members 32, respectively, when the bottom end cover 166*a* is secured to the overall beam assembly 24. Since the bottom end cover 166*a* is similar to the previously-described bottom end cover 166, similar parts appearing in FIG. 5 and FIG. 23, respectively, are represented by the same, corresponding reference numerals, except for the suffice "a" in the numerals of the latter. The body portion 198*a* further includes a pair of side edges 204*a*, a pair of integrally formed, longitudinally-extending alignment walls 500 extending inwardly from an inner surface 502 of the body portion, and a plurality of integrally-formed alignment bosses 504 extending inwardly from the inner surface 502. A pair of elastically-resilient bumper members 506 extend longitudinally along the body portion 198*a* and are located between the respective alignment walls 500 and side edges 204*a*. The bottom end cover 166*a* is attached to the overall beam assembly 24 via an upper clip member 507 (FIG. 24) and a lower clip member 509 (FIG. 25). The upper clip member 507 includes a body portion 508 and a pair of orthogonally and inwardly-extending spring arms 510 that engage above the arms 219 of the upper coupler bracket 212*a*, thereby coupling the bottom end cover 166*a* with the overall beam assembly 24. The body portion 508 includes a plurality of alignment apertures 512 that receive the alignment bosses 504 therein. The alignment apertures 512 may include integrally-formed quick connectors (not shown), or may be secured about the alignment bosses 504 via separate mechanical fasteners, such as quick-connect washers 514. The body portion 508 further includes a pair of elongated alignment apertures 515 that receive a pair of alignment bosses 516 therein. The upper clip member 507 further includes an integrally-formed light shield 517 extending upwardly from the body portion 508. The light shield 517 is positioned between the upper edge 200*a* of the bottom wall 44 of the beam member 26 when the bottom end cover 166*a* is coupled with the overall beam assembly 24. The lower clip member 509 (FIG. 25) includes a box-shaped body portion 520 and a pair of inwardly-extending spring arms 522 that engage a portion of an adjustment block 302*a* (FIG. 26) of a foot assembly 38, as described below, thereby coupling the bottom end cover 166*a* with the overall beam assembly 24. The lower clip member 509 further includes a pair of flanges 524 extending orthogonally to the body portion 520 and including alignment apertures 526 that receive the alignment bosses 504 therein. The alignment apertures 526 may include integrally-formed quick connectors (not shown), or may be secured about the alignment bosses 504 by separate mechanical fasteners, such as quick-connect washers 514.

Figure 20C:
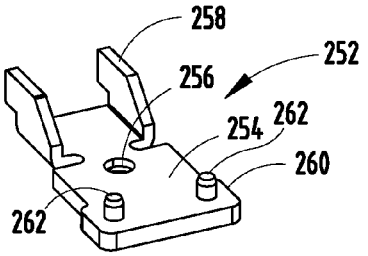
FIG. 20C is a perspective view of a connector bracket.

As best illustrated in FIG. 20C, a 90° end coupler bracket 252 can replace the upper coupler bracket 212 to secure the end of a beam member 26 to another beam member 26 in a 90° configuration. In the illustrated example, the 90° end coupler bracket 252 includes a planar body portion 254 having an aperture 256 and a pair of rearwardly-extending tabs 258 extending orthogonally from the body portion 254. The 90° end coupler bracket 252 is assembled with the beam member 26 by locating the tabs 258 within the apertures 246 of the beam 26 and securing the 90° end coupler bracket 252 with the beam member 26 via hardware, such as a bolt extending through aperture 248 of the beam 26, and the aperture 256 of the 90° end coupler bracket 252. In the illustrated example, the body portion 254 of the end coupler bracket 252 includes an end portion 260 that extends outwardly beyond an end of the beam member 26 once the 90° end coupler bracket 252 is secured thereto, and that includes a pair of guide pins 262 extending upwardly therefrom, that engage the circularly-shaped apertures 66 (FIG. 7) on the underside of the bottom wall 44 of the adjacent beam member 26 when the adjacent beam assemblies 24 are secured to one another in a 90° configuration. The adjacent beam assemblies are secured to one another in an in-line configuration via bolts and/or screws that extend through the apertures 220 and 222 of the upper coupler bracket 212 of each of the corresponding and aligned beam assemblies 24.

Figure 20D:
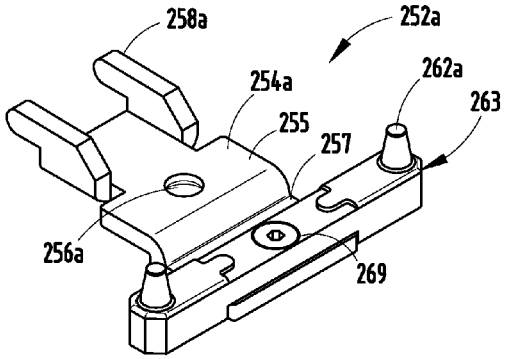
FIG. 20D is a perspective view of an alternative embodiment of the connector bracket.
Figure 20E:
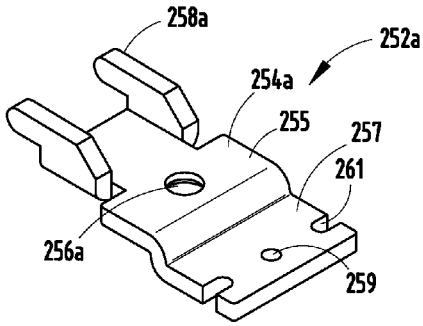
FIG. 20E is a perspective view of a first portion of the alternative connector bracket.
Figure 20F:
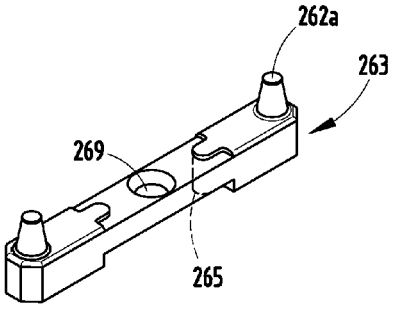
FIG. 20F is a perspective view of a second portion of the alternative connector bracket.

As best illustrated in FIGS. 20D-20F, an alternative 90° end coupler bracket 252*a* can replace the upper coupler bracket 212 to secure the end of a beam member 26 to another beam member 26 in a 90° configuration. In the illustrated example, the alternative 90° end coupler bracket 252*a* includes a planar body portion 254*a* having an upper portion 255 with an aperture 256*a* and a lower portion 257 with an aperture 259 and a pair of juxtaposed U-shaped notches 261. A pair of rearwardly-extending tabs 258*a* extend orthogonally from the body portion 254*a*. The bracket 252*a* further includes an engagement assembly 263 having a pair of upwardly-extending guide pins 262*a* and a pair of downwardly-extending U-shaped engagement portions 265 that are received within the notches 261. A screw 267 extends through an aperture 269 and is threadably received into the aperture 259. The 90° end coupler bracket 252*a* is assembled with the beam member 26 in a similar manner to the 90° end coupler bracket 252 as discussed above. The alternative coupler bracket 252*a* may also be utilized for end-to-end beam connections with end bracket. The end bracket includes a squared, generally figure-eight configuration with pairs of apertures located at opposite ends to receive the guide pins 262*a* of a pair of coupler brackets 252*a* therein, and apertures that align with apertures within the beam 26.

Figure 26:
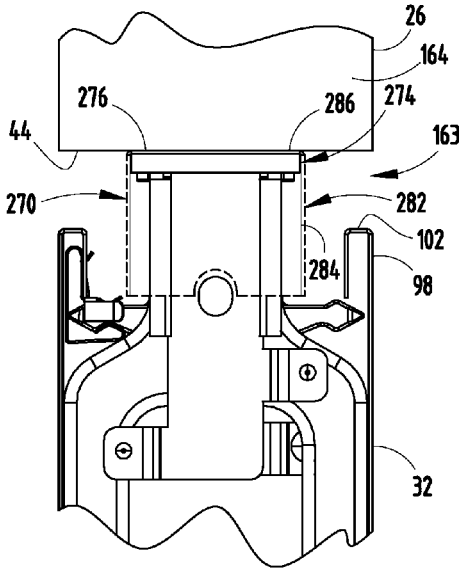
FIG. 26 is a partial end view of the beam assembly.
Figure 27:
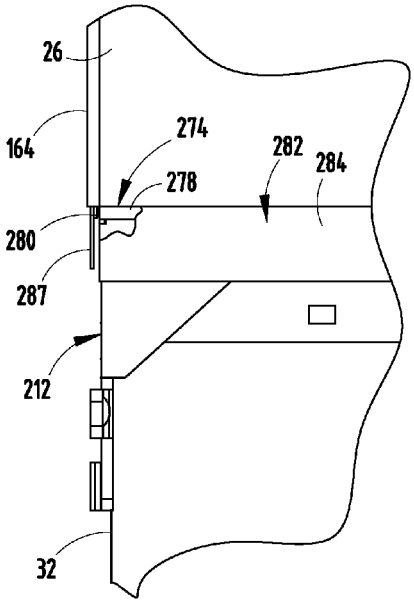
FIG. 27 is a partial side view of the beam assembly, with a portion of a light seal cut away to show a light seal support member.

As best illustrated in FIGS. 26 and 27, a light seal assembly 270 is provided to prevent light from passing through the wire routing gap 163 defined between the top edge 98 of the coupler panel 32 and the bottom wall 44 of the beam member 26. The light seal assembly 270 includes a semi-rigid light seal support member 274 that extends along the length of the beam assembly 24 and is secured to the bottom wall 44 of the beam member 26 by a plurality of mechanical fasteners, such as screws (not shown). The support member 274 includes a top wall 276 that abuts the bottom wall 44 of the beam member 26, a pair of longitudinally-extending sidewalls 278, and an end wall 280 located at opposite ends of the support member 274. The support member 274 is constructed of a relatively thin steel, however, other suitable materials such as plastic may also be utilized. The light seal assembly 270 further includes a flexible light seal 282 having a downwardly-extending portion 284 that extends from the bottom wall 44 of the beam member 26 to a vertical point that is below the uppermost edge 98 of the cover panels 32, and that extends along the length of the beam assembly 24, and at both ends 287. The light seal 282 (FIG. 27) further includes a support portion 280. The light seal 282 is preferably constructed of a flexible material that allows easy access to the wireway 34 via the gap 163. As described above, the end portions 287 of the light seal 282 may be replaced by the light shield portion 517 of the upper clip member 507.

Figure 28A:
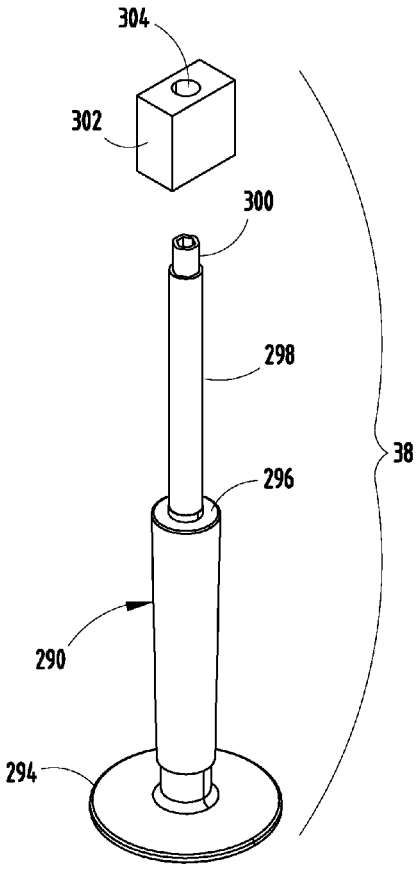
FIG. 28A is an exploded perspective view of a first foot assembly.
Figure 28B:
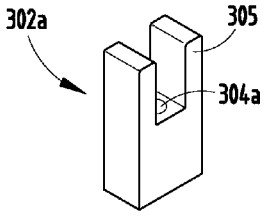
FIG. 28B is a perspective view of an alternative embodiment of an adjustment block of the first foot assembly.

The first foot assembly 38 (FIG. 28A) includes a pedestal 290 that includes a floor abutting foot member 294 and a threaded shaft 298. The threaded shaft 298 includes an adjustment nut integrally formed on a distal end thereof. The first foot assembly 38 further includes an adjustment block 302 having a threaded aperture 304 extending therethrough. In assembly, the adjustment block 302 is secured to and between the lower frame members 28 with the threaded shaft 298 being threadably received within the threaded aperture 304. Adjustment of the height of the beam assembly can be produced by hand turning of the pedestal or by utilizing a tool to engage the nut 300 of the threaded shaft 298, thereby adjusting the relative position of the adjustment block 302 along the length the threaded rod 298. Alternatively, the adjustment block 302*a* (FIG. 28B) includes a pair of upwardly-extending projections 305 that extend above the lower frame members 28 may be engaged by the spring arms 522 of the bracket 214*a*, thereby releasably coupling the bottom end cover 166*a* with the overall beam assembly 24.

The foot assembly 40 (FIGS. 9 and 29A) includes outwardly-extending arms 310 having floor engaging feet 312 secured thereto. Each arm 310 extends outwardly away from the general beam assembly 24 so as to provide lateral stability for the beam assembly 24 with respect to the supporting floor surface 36. The opposite end of each arm 310 includes an upwardly-extending adjustment block 314 fixedly secured to the associated arm 310 and including a plurality of bolt-receiving apertures 316 spaced along the length thereof. The foot assembly 40 further includes a pair of support brackets 318 each including a planar body portion 320 having a plurality of bolt-receiving apertures 322 extending therethrough, a pair of upwardly-opening hub portions 324 extending outwardly from opposite sides of the body portion 320, and a top wall 326 extending orthogonal to the body portion 320 and having an aperture 328 extending therethrough. The foot assembly 40 further includes a clamp member 330 having a planar body portion 332 and a plurality of downwardly-extending tabs 344 extending orthogonal to the body portion 332 and located at opposite corners thereto. Body portion 332 further includes a pair of apertures 336 extending therethrough.

An alternative foot assembly 40*a* (FIG. 29B) includes outwardly-extending arms 310*a* having floor engaging feet 312*a* secured thereto. Each arm 310*a* extends outwardly away from the general beam assembly 24 so as to provide lateral stability for the beam assembly 24 with respect to the supporting floor surface 36. The opposite end of each arm 310 includes an upwardly-extending adjustment block 314*a* fixedly secured to the associated arm 310*a* and including a plurality of bolt-receiving apertures 316 spaced along the length thereof. The foot assembly 40*a* further includes a pair of L-shaped upper attachment brackets 600 and a pair of L-shaped lower attachment brackets 602. Each upper attachment bracket 600 and lower attachment bracket 602 includes a first portion 604 and a second portion 610. In assembly, alignment bolts 620 are positioned through the bolt-receiving apertures, thereby vertically supporting the beam assembly 24, while a plurality of clamping bolts 622 are positioned within the apertures, thereby clamping the upper and lower attachment brackets 600, 602 to one another. Alternatively, the nuts associated with the bolts 620, 622 may be replaced by threaded apertures within brackets 600, 602.

In assembly, each arm 310 is secured to the supporting brackets 318 via bolts 338 that extend through the apertures 322 of the support brackets 318 and the apertures 316 of the adjustment blocks 314. The relative height of the support brackets 318 with respect to the arms 310 can be adjusted by selecting the appropriate apertures 316 within which the bolts 338 are placed. Bolts 340 are used to secure arms 310 to adjustment blocks 340. The assembly of the support brackets 318 and the arms 310 are then assembled with the overall beam assembly 24 by placing a portion of the body portion 320 of the support brackets 318 and a portion of the adjustment blocks 314 between the lower frame members 28, such that the hub portions 324 of the support brackets 318 engage apertures (not shown) located in the bottom side of each of the lower frame members 28. The clamp member 330 is then secured to the support brackets 318 by placing the tabs 334 of the clamp member 330 into corresponding apertures 88 located in the top wall 90 of the lower frame members 28 and threading bolts 344 through apertures 336 of the clamp member 330 and into apertures 328 of the support brackets 318.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The invention claimed is:

1. A beam assembly for subdividing a floor plan area, comprising:

a horizontally extending beam member defining an uppermost edge of a beam assembly;

a lowermost horizontally extending lower frame member located below the beam member;

a plurality of vertical frame members extending between and coupling the beam member with the lower frame member; and a first cover member disposed on a side of the vertical frame members and a second cover member disposed on an opposite side of the vertical frame members, at least one of the cover members including an upper edge spaced from the beam member sufficiently to allow electrical/communication lines to be routed from a location adjacent the beam member, between the upper edge of the at least one cover member and the beam member, and to a wireway located between the first cover panel and the second cover panel, wherein at least one of the cover members extends from a first location substantially proximate the beam member down at least to a second location located at a lowermost edge of the lowermost lower frame member, wherein the spacing between the horizontally extending beam member and the at least one cover member is configured for the electrical/communication lines to pass from outside the beam assembly to the wireway.

2. The beam assembly of claim 1 wherein the beam member includes at least one upwardly opening channel extending longitudinally along a length of the beam member and that is adapted to support work tools therefrom.

3. The beam assembly of claim 1 further comprising:

a first cover support member operably coupled to a bottom wall of the beam member and operably coupled to an upper edge of each of the cover members, wherein the first cover support member is separate from the vertical frame member.

4. The beam assembly of claim 3 further comprising:

at least one cover support clip operably coupled to the upper edge of at least one cover member and removably engaging the first cover support member, thereby supporting the at least one of cover member from the first cover support member.

5. The beam assembly of claim 1, wherein the at least one cover member extends from the first location to beneath the lowermost lower frame member.

6. The beam assembly of claim 1, wherein the upper edge of the at least one cover member is an uppermost edge.

7. A beam assembly for subdividing a floor plan area, comprising:

a horizontally extending beam member defining an uppermost edge of a beam assembly;

a lowermost horizontally extending lower frame member located below the upper frame member;

a plurality of vertical frame members extending between and coupling the upper frame member with the at least one lower frame member; and a first cover member disposed on a side of the vertical frame members and a second cover member disposed on an opposite side of the vertical frame members, at least one of the cover members including an upper edge spaced proximate and vertically below the beam member sufficiently to allow electrical/communication lines to be routed from a first position located outside of the beam assembly, between the upper edge of the at least one cover member and the beam member, and to a wireway located between the first cover member and the second cover member, wherein the spacing between the horizontally extending beam member and the at least one cover member is configured for the electrical/communication lines to pass from outside the beam assembly to the wireway.

8. The beam assembly of claim 7 wherein the beam member includes at least one upwardly opening channel extending longitudinally along a length of the beam and supporting a worktool therefrom.

9. The beam assembly of claim 7 wherein at least one of the cover members extends from a first location substantially proximate the beam member down at least to a second location located at a lowermost edge of the lowermost lower frame member.

10. The beam assembly of claim 9, wherein the at least one cover member extends from the first location to beneath the lowermost lower frame member.

11. The beam assembly of claim 7 further comprising:

a first cover support member operably coupled to a bottom wall of the beam member and operably coupled to an upper edge of each of the cover members.

12. The beam assembly of claim 11 further comprising:

at least one cover support clip operably coupled to the upper edge of at least one cover member and removably engaging the first cover support member, thereby supporting the at least one of cover member from the first cover support member.

13. The beam assembly of claim 7, wherein the upper edge of the at least one cover member is an uppermost edge.

14. A beam assembly for subdividing a floor plan area, comprising:

a horizontally extending beam member defining an uppermost edge of a beam assembly;

a lowermost horizontally extending lower frame member located below the beam member;

a plurality of vertical frame members extending between and coupling the beam member with the lower frame member; and a first cover member disposed on a side of the vertical frame members and a second cover member disposed on an opposite side of the vertical frame members, at least one of the cover members including an upper edge spaced from the beam member sufficiently to allow electrical/communication lines to be routed from a location not located between the first cover panel and the second cover panel, between the upper edge of the at least one cover member and the beam member, and to a wireway located between the first cover panel and the second cover panel, wherein at least one of the cover members extends from a first location substantially proximate the beam member down at least to a second location located at a lowermost edge of the lowermost lower frame member, wherein the spacing between the horizontally extending beam member and the at least one cover member is configured for the electrical/communication lines to pass from outside the beam assembly to the wireway.

15. The beam assembly of claim 14, wherein the beam member includes at least one upwardly opening channel extending longitudinally along a length of the beam member and that is adapted to support work tools therefrom.

16. The beam assembly of claim 14, further comprising:

a first cover support member operably coupled to a bottom wall of the beam member and operably coupled to an upper edge of each of the cover members, wherein the first cover support member is separate from the vertical member.

* * * * *